US011359771B2

(12) United States Patent
Bosua et al.

(10) Patent No.: US 11,359,771 B2
(45) Date of Patent: Jun. 14, 2022

(54) LIGHTING ASSEMBLY

(71) Applicant: LIFI Labs, Inc., San Francisco, CA (US)

(72) Inventors: Phillip Anthony Bosua, San Francisco, CA (US); Marc Alexander, San Francisco, CA (US)

(73) Assignee: LIFI Labs, Inc., San Francisco, CA (US)

( * ) Notice: Subject to any disclaimer, the term of this patent is extended or adjusted under 35 U.S.C. 154(b) by 0 days.

(21) Appl. No.: 17/080,607

(22) Filed: Oct. 26, 2020

(65) Prior Publication Data

US 2021/0054973 A1 Feb. 25, 2021

Related U.S. Application Data

(63) Continuation of application No. 16/289,119, filed on Feb. 28, 2019, now Pat. No. 10,851,950, which is a (Continued)

(51) Int. Cl.
*F21K 9/232* (2016.01)
*F21V 29/83* (2015.01)
(Continued)

(52) U.S. Cl.
CPC ..... *F21K 9/232* (2016.08); *F21V 29/83* (2015.01); *H05B 45/48* (2020.01); *H05B 47/19* (2020.01);
(Continued)

(58) Field of Classification Search
CPC ..... F21K 9/23–238
See application file for complete search history.

(56) References Cited

U.S. PATENT DOCUMENTS 4,942,386 A 7/1990 Willis
5,420,607 A 5/1995 Miller et al.
(Continued)

FOREIGN PATENT DOCUMENTS

CN 101897236 A 11/2010
CN 201986217 U 9/2011
(Continued)

OTHER PUBLICATIONS

"A New Kind of Clean, Vyv Antimicrobial Light works around the clock to create cleaner environments in the places we live, work, and play", viv, https://vyv.tech, downloaded Sep. 24, 2020.
(Continued)

*Primary Examiner* — Sean P Gramling
(74) *Attorney, Agent, or Firm* — Jeffrey Schox; Diana Lin

(57) ABSTRACT

A lighting assembly including a shell, wherein the shell includes an inner wall defining an inner lumen, an outer wall encircling the inner wall, a set of radial fins connecting the inner and outer walls, the set of fins cooperatively defining a set of cooling channels between adjacent fins, the inner wall, and the outer wall; an insert removably mounted within the inner lumen, the insert defining a power storage lumen; a power storage unit arranged within the power storage lumen; a circuit board coupled to the power storage unit, the circuit board comprising a processor and communication module; a lighting module electrically connected to the circuit board, wherein the lighting module includes a substrate and a set of light emitting elements mounted to a first broad face of the substrate.

18 Claims, 8 Drawing Sheets

Related U.S. Application Data continuation of application No. 16/035,292, filed on Jul. 13, 2018, now abandoned, which is a continuation of application No. 14/512,669, filed on Oct. 13, 2014, now Pat. No. 10,047,912.

(60) Provisional application No. 61/891,094, filed on Oct. 15, 2013.

(51) Int. Cl.

| | |
|---|---|
| ***H05B 45/48*** | (2020.01) |
| ***H05B 47/19*** | (2020.01) |
| *F21S 9/02* | (2006.01) |
| *F21V 3/02* | (2006.01) |
| *F21V 19/00* | (2006.01) |
| *F21V 23/04* | (2006.01) |
| *F21V 29/70* | (2015.01) |
| *F21V 29/85* | (2015.01) |
| *F21Y 105/00* | (2016.01) |
| *F21Y 115/10* | (2016.01) |
| *F21Y 115/15* | (2016.01) |
| *F21Y 107/20* | (2016.01) |

(52) U.S. Cl.

CPC ..... *F21S 9/022* (2013.01); *F21V 3/02* (2013.01); *F21V 19/0035* (2013.01); *F21V 23/0442* (2013.01); *F21V 23/0464* (2013.01); *F21V 29/70* (2015.01); *F21V 29/85* (2015.01); *F21Y 2105/00* (2013.01); *F21Y 2107/20* (2016.08); *F21Y 2115/10* (2016.08); *F21Y 2115/15* (2016.08)

(56) References Cited

U.S. PATENT DOCUMENTS

| | | | |
|---|---|---|---|
| 5,710,545 | A | 1/1998 | Dunn |
| 5,769,527 | A | 6/1998 | Taylor et al. |
| 5,790,114 | A | 8/1998 | Geaghan et al. |
| 5,841,428 | A | 11/1998 | Jaeger et al. |
| 5,914,669 | A | 6/1999 | Wicks et al. |
| 6,003,206 | A | 12/1999 | Hall et al. |
| 6,121,976 | A | 9/2000 | Lu |
| 6,329,990 | B1 | 12/2001 | Lapstun et al. |
| 6,624,368 | B2 | 9/2003 | Sato et al. |
| 6,694,125 | B2 | 2/2004 | White et al. |
| 6,726,112 | B1 | 4/2004 | Ho |
| 6,759,966 | B1 | 7/2004 | Weng |
| 6,949,885 | B2 | 9/2005 | Hamamoto et al. |
| 7,103,460 | B1 | 9/2006 | Breed |
| 7,205,495 | B2 | 4/2007 | Mazur |
| 7,221,271 | B2 | 5/2007 | Reime |
| 7,339,128 | B2 | 3/2008 | Yen |
| 7,418,392 | B1 | 8/2008 | Mozer et al. |
| 7,446,671 | B2 | 11/2008 | Giannopoulos et al. |
| 7,474,632 | B2 | 1/2009 | Ban |
| 7,502,033 | B1 | 3/2009 | Axelrod |
| 7,573,208 | B2 | 8/2009 | Newman |
| 7,597,455 | B2 | 10/2009 | Smith et al. |
| 7,598,885 | B2 | 10/2009 | Kwon et al. |
| 7,667,163 | B2 | 2/2010 | Ashworth et al. |
| 7,852,322 | B2 | 12/2010 | Park |
| 7,859,398 | B2 | 12/2010 | Davidson et al. |
| 7,884,556 | B2 | 2/2011 | Gandhi |
| 7,952,322 | B2 | 5/2011 | Partovi et al. |
| 7,980,726 | B2 | 7/2011 | Joosen et al. |
| 8,013,545 | B2 | 9/2011 | Jonsson |
| 8,024,517 | B2 | 9/2011 | Lafrese et al. |
| 8,033,686 | B2 | 10/2011 | Recker et al. |
| 8,035,320 | B2 | 10/2011 | Sibert |
| 8,100,552 | B2 | 1/2012 | Spero |
| 8,115,369 | B2 | 2/2012 | Kang et al. |
| 8,160,514 | B2 | 4/2012 | Aparin et al. |
| 8,195,313 | B1 | 6/2012 | Fadell et al. |
| 8,207,821 | B2 | 6/2012 | Roberge et al. |
| 8,253,344 | B2 | 8/2012 | Guest et al. |
| 8,282,250 | B1 | 10/2012 | Dassanayake et al. |
| 8,294,379 | B2 | 10/2012 | Liu et al. |
| 8,299,719 | B1 | 10/2012 | Moshirnoroozi |
| 8,314,566 | B2 | 11/2012 | Steele et al. |
| 8,334,777 | B2 | 12/2012 | Wilson et al. |
| 8,373,360 | B2 | 2/2013 | Leung et al. |
| 8,390,201 | B2 | 3/2013 | Yasuda et al. |
| 8,390,207 | B2 | 3/2013 | Dowling et al. |
| 8,433,530 | B2 | 4/2013 | Shimada et al. |
| 8,446,288 | B2 | 5/2013 | Mizushima et al. |
| 8,491,159 | B2 | 7/2013 | Recker et al. |
| 8,523,410 | B2 | 9/2013 | Hashimoto et al. |
| 8,562,158 | B2 | 10/2013 | Chien |
| 8,569,968 | B2 | 10/2013 | Hsiao et al. |
| 8,581,512 | B2 | 11/2013 | Hamamoto et al. |
| 8,593,073 | B2 | 11/2013 | Aldrich et al. |
| 8,641,241 | B2 | 2/2014 | Farmer |
| 8,669,716 | B2 | 3/2014 | Recker et al. |
| 8,723,434 | B2 | 5/2014 | Watson et al. |
| 8,723,794 | B2 | 5/2014 | Corson et al. |
| 8,742,594 | B2 | 6/2014 | Daubenspeck et al. |
| 8,742,694 | B2 | 6/2014 | Bora et al. |
| 8,743,023 | B2 | 6/2014 | Maxik et al. |
| 8,743,923 | B2 | 6/2014 | Geske et al. |
| 8,755,561 | B2 | 6/2014 | Vlutters et al. |
| 8,760,370 | B2 | 6/2014 | Maxik et al. |
| 8,760,514 | B2 | 6/2014 | Chien |
| 8,764,251 | B2 | 7/2014 | Lien |
| 8,770,771 | B2 | 7/2014 | Preta et al. |
| 8,788,966 | B2 | 7/2014 | Josephson et al. |
| 8,812,827 | B2 | 8/2014 | Malasani |
| 8,820,984 | B2 | 9/2014 | Gillio |
| 8,829,799 | B2 | 9/2014 | Recker et al. |
| 8,834,009 | B2 | 9/2014 | Chien |
| 8,858,029 | B2 | 10/2014 | Brandes et al. |
| 8,888,306 | B2 | 11/2014 | Thomas et al. |
| 8,890,435 | B2 | 11/2014 | Bora et al. |
| 8,902,049 | B2 | 12/2014 | Fushimi et al. |
| 8,928,232 | B2 | 1/2015 | Aggarwal et al. |
| 8,941,013 | B2 | 1/2015 | Arnold |
| 8,947,013 | B2 | 2/2015 | Sutardja et al. |
| 8,960,940 | B2 | 2/2015 | Hellkamp |
| 8,981,913 | B2 | 3/2015 | Henig et al. |
| 8,994,276 | B2 | 3/2015 | Recker et al. |
| 9,024,517 | B2 | 5/2015 | Yuan et al. |
| 9,030,120 | B2 | 5/2015 | Pickard et al. |
| 9,039,233 | B2 | 5/2015 | Fournier et al. |
| 9,049,756 | B2 | 6/2015 | Klusmann et al. |
| 9,055,055 | B1 | 6/2015 | Strand et al. |
| 9,074,736 | B2 | 7/2015 | Recker et al. |
| 9,080,758 | B2 | 7/2015 | Igaki et al. |
| 9,113,528 | B2 | 8/2015 | Bora et al. |
| 9,172,917 | B1 | 10/2015 | Fu et al. |
| 9,192,032 | B2 | 11/2015 | Kwag et al. |
| 9,247,625 | B2 | 1/2016 | Recker et al. |
| 9,253,859 | B2 | 2/2016 | Chung |
| 9,326,359 | B2 | 4/2016 | Bosua |
| 9,338,864 | B2 | 5/2016 | Bosua et al. |
| 9,345,098 | B2 | 5/2016 | Joseph et al. |
| 9,351,378 | B2 | 5/2016 | Aggarwal et al. |
| 9,368,695 | B2 | 6/2016 | David et al. |
| 9,404,624 | B2 | 8/2016 | Chung |
| 9,408,282 | B1 | 8/2016 | Springer |
| 9,410,664 | B2 | 8/2016 | Krames et al. |
| 9,510,426 | B2 | 11/2016 | Chemel et al. |
| 9,526,151 | B2 | 12/2016 | Kreiner et al. |
| 9,534,773 | B1 | 1/2017 | Turudic |
| 9,538,619 | B2 | 1/2017 | Swatsky et al. |
| 9,578,722 | B2 | 2/2017 | Feng et al. |
| 9,644,799 | B2 * | 5/2017 | Crayford ..... F21V 23/005 |
| 9,651,243 | B1 | 5/2017 | Springer |
| 9,677,755 | B1 | 6/2017 | Linnell et al. |
| 9,699,871 | B2 | 7/2017 | Karc et al. |
| 9,936,566 | B2 | 4/2018 | Alexander et al. |
| 10,047,912 | B2 | 8/2018 | Bosua et al. |
| 10,085,331 | B2 | 9/2018 | Alexander et al. |

(56) References Cited

U.S. PATENT DOCUMENTS 10,129,965 B2 11/2018 Bosua et al.
10,136,292 B2 11/2018 Bosua et al.
2002/0047628 A1 4/2002 Morgan et al.
2002/0111135 A1 8/2002 White et al.
2002/0145394 A1 10/2002 Morgan et al.
2003/0019734 A1 1/2003 Sato et al.
2003/0117408 A1 6/2003 Forsline et al.
2004/0105264 A1 6/2004 Spero
2004/0129946 A1 7/2004 Nagai et al.
2004/0160198 A1 8/2004 Hewlett et al.
2005/0116667 A1 6/2005 Mueller et al.
2005/0236263 A1 10/2005 Mazur
2005/0237341 A1 10/2005 Gangnet et al.
2005/0278778 A1 12/2005 D et al.
2006/0002309 A1 1/2006 Ban
2006/0044800 A1 3/2006 Reime
2006/0047132 A1 3/2006 Shenai-Khatkhate et al.
2006/0049935 A1 3/2006 Giannopoulos et al.
2006/0139907 A1 6/2006 Yen
2006/0198157 A1 9/2006 Ruan
2007/0119484 A1 5/2007 Kwon et al.
2007/0145915 A1 6/2007 Roberge et al.
2007/0182367 A1 8/2007 Partovi
2008/0006709 A1 1/2008 Ashworth et al.
2008/0049043 A1 2/2008 Titmuss et al.
2008/0062192 A1 3/2008 Voliter et al.
2008/0092800 A1 4/2008 Smith et al.
2008/0106887 A1 5/2008 Salsbury et al.
2008/0143273 A1 6/2008 Davidson et al.
2008/0198175 A1 8/2008 Sun et al.
2008/0218099 A1 9/2008 Newman
2008/0265799 A1 10/2008 Sibert
2009/0052182 A1 2/2009 Matsuba et al.
2009/0121651 A1 5/2009 Gandhi
2009/0128059 A1 5/2009 Joosen et al.
2009/0146982 A1 6/2009 Thielman et al.
2009/0190338 A1 7/2009 Huang
2009/0251127 A1 10/2009 Kim
2009/0284169 A1 11/2009 Valois
2009/0295310 A1 12/2009 Duerr et al.
2010/0068899 A1 3/2010 Shvili
2010/0070217 A1 3/2010 Shimada et al.
2010/0118527 A1 5/2010 Choong
2010/0127638 A1 5/2010 Lan et al.
2010/0141153 A1 6/2010 Recker et al.
2010/0172120 A1 7/2010 Wegh et al.
2010/0194687 A1 8/2010 Corson et al.
2010/0207534 A1 8/2010 Dowling et al.
2010/0277067 A1 11/2010 Maxik et al.
2010/0289664 A1 11/2010 Mizushima et al.
2010/0296285 A1 11/2010 Chemel et al.
2010/0301773 A1 12/2010 Chemel et al.
2010/0327766 A1 12/2010 Recker et al.
2011/0050120 A1 3/2011 Leung et al.
2011/0074672 A1 3/2011 Diederiks et al.
2011/0089838 A1 4/2011 Pickard et al.
2011/0089842 A1 4/2011 Aldrich et al.
2011/0095687 A1 4/2011 Jonsson
2011/0109216 A1 5/2011 Kang et al.
2011/0109249 A1 5/2011 Liu et al.
2011/0133655 A1 6/2011 Recker et al.
2011/0161865 A1 6/2011 Josephsoon et al.
2011/0163683 A1 7/2011 Steele et al.
2011/0199004 A1 8/2011 Henig et al.
2011/0216085 A1 9/2011 Bergman et al.
2011/0227469 A1 9/2011 Yuan et al.
2011/0227495 A1 9/2011 Guest et al.
2011/0234366 A1 9/2011 Feng et al.
2011/0260648 A1 10/2011 Hamamoto et al.
2011/0285515 A1 11/2011 Fushimi et al.
2011/0309769 A1 12/2011 Kuroki et al.
2012/0025717 A1 2/2012 Klusmann et al.
2012/0026726 A1 2/2012 Recker et al.
2012/0080944 A1 4/2012 Recker et al.
2012/0120243 A1 5/2012 Chien
2012/0126699 A1 5/2012 Zittel
2012/0130547 A1 5/2012 Fadell et al.
2012/0146505 A1 6/2012 Jonsson
2012/0147604 A1 6/2012 Farmer
2012/0195053 A1 8/2012 Wu
2012/0206050 A1 8/2012 Spero
2012/0218421 A1 8/2012 Chien
2012/0224381 A1 9/2012 Hashimoto et al.
2012/0281879 A1 11/2012 Vlutters et al.
2012/0287488 A1 11/2012 Oto
2012/0300441 A1 11/2012 Thomas et al.
2013/0021795 A1 1/2013 Chien
2013/0038230 A1 2/2013 Brown et al.
2013/0063042 A1 3/2013 Bora et al.
2013/0106283 A1 5/2013 Gillio
2013/0113715 A1 5/2013 Grant et al.
2013/0121569 A1 5/2013 Yadav
2013/0148341 A1 6/2013 Williams
2013/0154985 A1 6/2013 Miyazaki
2013/0193847 A1 8/2013 Recker et al.
2013/0249392 A1* 9/2013 Kim ..... F21K 9/23 315/34
2013/0249435 A1 9/2013 Hellkamp
2013/0257312 A1 10/2013 Maxik et al.
2013/0264943 A1 10/2013 Bora et al.
2013/0278132 A1 10/2013 Yuan et al.
2013/0278162 A1 10/2013 Watson et al.
2013/0278172 A1 10/2013 Maxik et al.
2013/0292106 A1 11/2013 Lien
2013/0314680 A1 11/2013 Yamamura
2013/0326381 A1 12/2013 Pereira et al.
2014/0021862 A1 1/2014 Chung
2014/0028199 A1 1/2014 Chemel
2014/0029749 A1 1/2014 Malasani
2014/0043825 A1 2/2014 Brandes et al.
2014/0046152 A1 2/2014 Bechtel et al.
2014/0049983 A1 2/2014 Nichol et al.
2014/0084809 A1 3/2014 Catalano
2014/0117859 A1 5/2014 Swatsky et al.
2014/0152188 A1 6/2014 Bora et al.
2014/0159600 A1 6/2014 Sutardja et al.
2014/0239811 A1 8/2014 Kreiner et al.
2014/0265864 A1 9/2014 Hickok et al.
2014/0265900 A1 9/2014 Sadwick et al.
2014/0273715 A1 9/2014 Moll et al.
2014/0273892 A1 9/2014 Nourbakhsh
2014/0285999 A1 9/2014 Luna et al.
2014/0300293 A1 10/2014 Ruan et al.
2014/0300294 A1 10/2014 Zampini et al.
2014/0354150 A1 12/2014 Joseph et al.
2015/0015165 A1 1/2015 Engelen et al.
2015/0038246 A1 2/2015 Zeid
2015/0048760 A1 2/2015 Kwag et al.
2015/0062892 A1 3/2015 Krames et al.
2015/0084513 A1 3/2015 Anthony et al.
2015/0103515 A1 4/2015 Bosua et al.
2015/0103520 A1 4/2015 Fournier et al.
2015/0130359 A1 5/2015 Bosua et al.
2015/0141755 A1 5/2015 Tesar
2015/0189721 A1 7/2015 Karc et al.
2015/0208900 A1 7/2015 Vidas et al.
2015/0236225 A1 8/2015 David et al.
2015/0250042 A1 9/2015 Aggarwal et al.
2015/0345764 A1 12/2015 Hussey et al.
2015/0359061 A1 12/2015 Adler
2015/0382463 A1 12/2015 Kim et al.
2016/0007431 A1 1/2016 Bosua et al.
2016/0066393 A1 3/2016 Bosua
2016/0066397 A1 3/2016 Alexander et al.
2016/0073474 A1 3/2016 Van De Sluis et al.
2016/0100086 A1 4/2016 Chien
2016/0264054 A1 9/2016 Uken et al.
2017/0118815 A1 4/2017 Altamura et al.
2017/0163439 A1 6/2017 Bosua et al.
2017/0231072 A1 8/2017 Bosua et al.
2017/0309215 A1 10/2017 Perdices-Gonzalez et al.
2017/0310940 A1 10/2017 Perdices-Gonzalez et al.

(56) References Cited

U.S. PATENT DOCUMENTS

| | | | |
|---|---|---|---|
| 2017/0310956 | A1 | 10/2017 | Perdices-Gonzalez et al. |
| 2019/0034106 | A1 | 1/2019 | Shin et al. |

FOREIGN PATENT DOCUMENTS

| | | | |
|---|---|---|---|
| CN | 102573220 | A | 7/2012 |
| CN | 103067492 | A | 4/2013 |
| CN | 203099410 | U | 7/2013 |

OTHER PUBLICATIONS

"The Light with the Power to Boost your Defense Against Bacteria", Ellumi Lighting, LED Germ Killing Disinfection Lighting, https://www.ellumilighting.com, downloaded Sep. 25, 2020.
Boost Your Sales Immediately. Add an LED Display From Cirrus, https://cirrusled.com/.
Clover Juli, https: Review: Nanoleafs 'Aurora Smarter Kit' Offers Awesome HomeKit-Enabled Mood Lighting for $200, Jan. 27, 2017, //www.macrumors.com/review/nanoleaf-aurora-smarter-kit/.
Reyes Kimberly, User Story: Grain Lighting, Oct. 21, 2013, https://www.typeamachines.com/additive-manufacturing/user-story-grain-lighting.

* cited by examiner

LIGHTING ASSEMBLY

CROSS-REFERENCE TO RELATED APPLICATIONS

This application is a continuation of U.S. application Ser. No. 16/289,119, filed 28 Feb. 2020, which is a continuation of U.S. application Ser. No. 16/035,292 filed 13 Jul. 2018, which is a continuation of U.S. application Ser. No. 14/512,669 filed 13 Oct. 2014, now issued as U.S. Pat. No. 10,047,912, which claims the benefit of U.S. Provisional Application No. 61/891,094 filed 15 Oct. 2013, all of which are incorporated in their entirety by this reference.

TECHNICAL FIELD

This invention relates generally to the lighting systems field, and more specifically to a new and useful lighting assembly and housing in the lighting systems field.

DESCRIPTION OF THE PREFERRED EMBODIMENTS

The following description of the preferred embodiments of the invention is not intended to limit the invention to these preferred embodiments, but rather to enable any person skilled in the art to make and use this invention.

Figure 1:
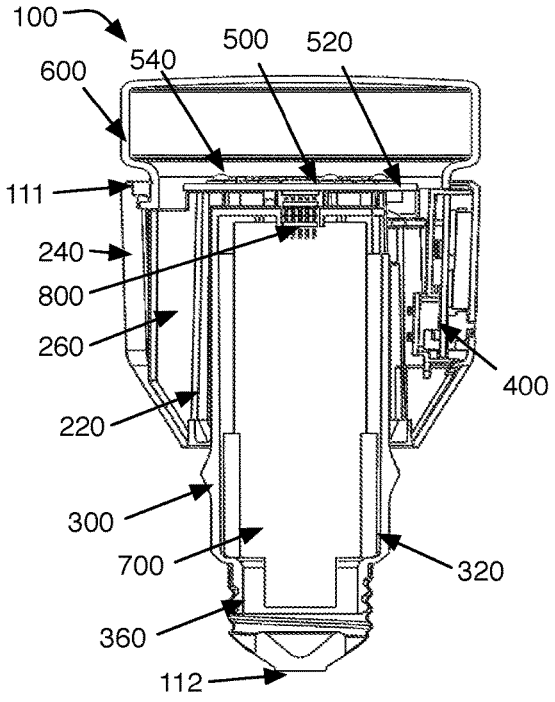
FIG. 1 is a sectional view of a variation of the lighting assembly.
Figure 2:
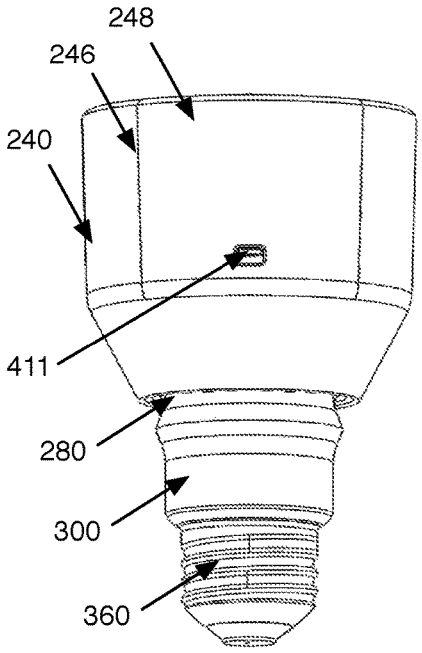
FIG. 2 is a perspective view of a variation of the lighting assembly including an access point and reset switch.
Figure 3:
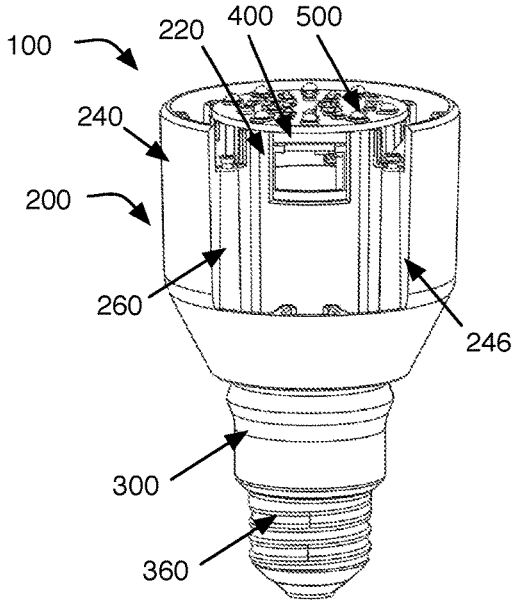
FIG. 3 is a cutaway view of a variation of the lighting assembly including an access point.

As shown in FIG. 1, the lighting assembly 100 includes a shell 200 including an inner wall 220 defining an inner lumen 222 and a set of fins 260 extending radially from the inner wall 220, an insert 300 removably coupled within the inner lumen 222, a circuit board 400, a lighting module 500 electrically connected to the circuit board 400, and a diffuser 600. The shell 200 can additionally include an outer wall 240. The lighting assembly 100 can additionally include a power storage unit 700, wherein the insert 300 can define a power storage lumen 320 in which the power storage unit 700 is arranged.

Figure 4:
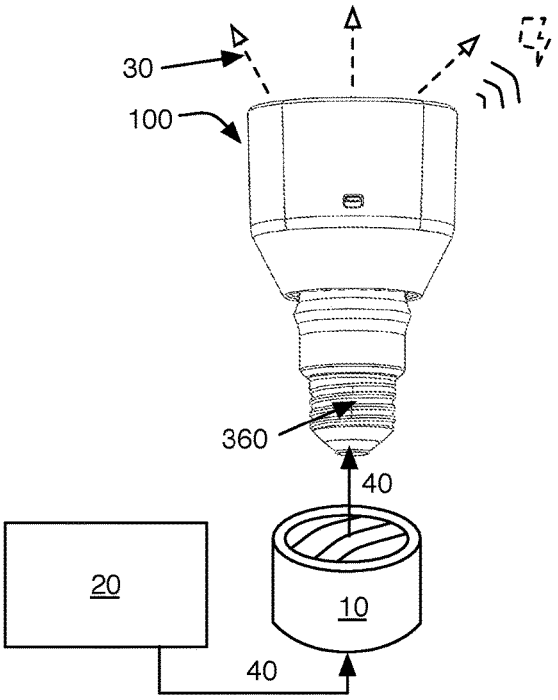
FIG. 4 is a schematic representation of a variation of the lighting assembly interacting with a socket.

The lighting assembly 100 functions to provide a wirelessly-connected lighting solution, wherein a device connected to the communications module can control lighting assembly operation, receive information from the lighting assembly 100, or otherwise interact with the lighting assembly 100. The lighting assembly 100 functions to removably mount to a fixture or socket, more preferably a lighting fixture or socket, but can alternatively permanently or transiently mount to any other mounting point. As shown in FIG. 4, the fixture or socket is preferably electrically connectable to a primary power source 20, such as power grid, wherein the lighting assembly 100 preferably receives and powers the lighting assembly components based on power 40 from the primary power source 20. The lighting assembly 100 further functions to cool components with high power requirements and/or heat output, such as the communications module, lighting module 500, and/or power storage unit 700. The lighting assembly 100 can additionally function as a wireless signal repeater, such as a wireless router repeater.

Variants of the lighting assembly 100 can confer benefits over conventional lighting assemblies. First, by using modern light emitting elements 540, such as LEDs, variants of the lighting assembly 100 can decrease power consumption over conventional lighting solutions, increase lighting assembly lifespan over conventional lighting solutions, and, in some variants, reduce the cooling requirement for the light emitting elements 540.

Second, by incorporating a communication module 420, variants of the lighting assembly 100 can enable remote individual or group lighting assembly control without adjusting power provision to each lighting assembly 100 from a primary power source. The communication module 420 can additionally enable information routing or any other suitable communication with one or more remote devices.

Third, variants of the lighting assembly 100 incorporating a power supply unit can provide backup power to the lighting assembly components when primary power source power provision has ceased (e.g., when an electrically connected light switch is in an off or disconnected position). For example, the power source can power on-board digital memory, such that settings for light emitting element operation can be stored and retrieved. In a second example, the power source can power the communication module 420, such that wireless or wired communication with the lighting assembly 100 is enabled despite primary power cessation. In a third example, the power source can power the light emitting elements 540, such as during an emergency event.

Fourth, incorporating an insert 300 into the housing assembly 110 can confer several benefits. First, the insert 300 enables top-down assembly of the power source into the lighting assembly 100, wherein the power source can be inserted into a lumen within the insert 300, and the insert 300 subsequently inserted into the shell 200. Second, the insert 300 simplifies manufacture, particularly when the insert 300 is tubular. In particular, manufacturing a tube with minimal external and/or internal features can be simpler and/or cheaper (e.g., through extrusion or injection molding) than manufacturing the complex lighting assembly housing as a unitary piece. Third, the insert 300 can function to thermally insulate components contained within the insert, such as the power source, from high heat output components and/or the thermally conductive shell 200.

Fifth, incorporating an outer wall 240 into the housing assembly 110 can confer several benefits. First, the outer wall 240 smoothes out the housing exterior and covers the fins 260, which lends to a minimalistic aesthetic. Second, the outer wall 240 prevents contaminant buildup between the fins 260 that would otherwise thermally insulate the lighting assembly 100. Third, the outer wall 240 can cooperatively form enclosed cooling channels 280 with the inner wall 220 and adjacent fins 260, which can function to facilitate natural convection through the shell 200.

Sixth, some arrangements of high heat output and low heat output components within the lighting assembly 100 can confer benefits over conventional systems. In particular, the high heat output and low heat output components can be strategically arranged to generate heat gradients that facilitate natural convection. In one example, the high heat output components can be arranged at a first housing assembly end, and the low heat output components can be arranged at a second housing assembly end. In variants wherein the lighting arrangement is configured to be arranged with the longitudinal axis within a threshold angular range of a gravity vector, this arrangement can generate natural convection. In a first embodiment, hot components can be arranged distal the gravity vector direction, such that the heated fluid proximal the hot components rises and forms a vacuum, thereby causing cool air from the ambient environment and/or proximal the cooler components to rise to cool the hot components. In a second embodiment, hot components can be arranged proximal the gravity vector direction, such that the heated fluid proximal the hot components rises and pulls cooler fluid from the ambient environment into the cooling channel 280 to cool the hot components.

The shell 200 of the housing assembly 110 of the lighting assembly 100 functions to mechanically protect the lighting assembly components. The shell 200 can additionally function as a heatsink for the lighting assembly components, and conduct heat from the components to the ambient environment, a heat transfer fluid 101 (e.g., cooling fluid), or any other suitable cooling medium. The shell 200 is preferably thermally conductive, but can alternatively be partially thermally insulative or entirely thermally insualtive. The shell 200 is preferably a singular piece that is cast, molded, machined, printed, sintered or otherwise manufactured, but can alternatively be formed from multiple pieces that are joined during assembly or formed in any other suitable manner. When the shell 200 is formed from multiple pieces, all pieces are preferably thermally conductive, but a subset of the pieces can alternatively be thermally insulative, have different thermal properties (e.g., different thermal conductivity), or vary in any other suitable manner. The shell 200 can be formed from metal (e.g., aluminum, copper, steel, gold, composites, etc.), from thermally conductive polymers (e.g., polymers including heat-conductive additives or coatings, such as graphite carbon fiber, aluminum nitride, boron nitride, or metals, or any other suitable thermally conductive polymer), wherein the thermally conductive polymer can be electrically conductive (e.g., polymers including graphite carbon fiber, etc.) or electrically insulative (e.g., polymers including ceramics, such as aluminum nitride, boron nitride, etc.), or be formed from any other suitable thermally conductive material. The thermally conductive polymer can have thermally conductivity 10-50 times higher than a base thermoplastic (e.g., 10-100 W/mK), 100-500 times higher than a base thermoplastic (e.g., 10-100 W/mK), or have any other suitable thermal conductivity. Shells formed from plastic can be preferred in some variations to reduce electromagnetic interference with the antenna. The shell 200 preferably includes an inner wall 220 and a set of fins 260. The shell 200 can additionally include an outer wall 240 or any other suitable component.

The inner wall 220 of the shell 200 functions to support the fins 260. The inner wall 220 can additionally function to receive the insert. The inner wall 220 can additionally function to cooperatively define the cooling channels 280 with the fins 260. The inner wall 220 can additionally thermally couple to heat-generating components, such as the circuit board 400 or lighting module 500, such that the inner wall 220 can function as a heatsink for the heat-generating components. The inner wall 220 can include an exterior surface 224 from which the fins extend. The inner wall 220 is preferably thermally conductive, but can alternatively be thermally insulative, more or less thermally conductive than the fins 260 or outer wall 240, or have any other suitable thermal property.

The inner wall 220 is preferably tubular, but can alternatively be spherical or have any other suitable configuration. The inner wall exterior cross section is preferably substantially similar to the outer wall cross section, but can alternatively be different. In variants wherein the inner wall 220 defines an inner lumen 222, the inner lumen cross section is preferably substantially similar to the insert cross section, but can alternatively be different. The inner wall 220 can be cylindrical, with an ovular or circular cross section, have a square cross section, a triangular cross section, octagonal cross section, or have any other suitable cross section. The inner wall 220 preferably includes a longitudinal axis along its length. The length of the inner wall 220 can be substantially similar to the length of the outer wall 240, longer than the outer wall 240, shorter than the outer wall 240, similar to the length of the fin portion adjoining the inner wall 220, or have any other suitable length. The inner wall thickness is preferably substantially similar to that of the outer wall 240, but can alternatively be thicker, thinner, or have any other suitable configuration. The inner wall thickness is preferably substantially constant, but can alternatively vary along its length, vary along different angular sections, or vary in any other suitable manner. The inner wall 220 is preferably substantially continuous, but can alternatively include apertures through the inner wall thickness (e.g., cooling features) or any other suitable feature.

The inner wall 220 can define an inner lumen 222 that functions to receive the insert, such that the inner wall 220 additionally includes an interior surface 226 defining the inner lumen 222. The inner lumen 222 is preferably keyed with alignment features for the insert, such as grooves, protrusions, or other alignment features. The inner lumen 222 can additionally include retention features for the insert, such as hooks, grooves, clips, threading, or any other suitable retention feature. The inner lumen 222 can additionally or alternatively include any other suitable features. The inner lumen 222 preferably defines a first and second opposing end, but can alternatively define a single open end, be substantially closed, or have any other suitable configuration. The inner lumen 222 preferably receives the insert 300 from the second open end, but can alternatively receive the insert 300 from the first open end, or from any other suitable aperture.

Figure 9:
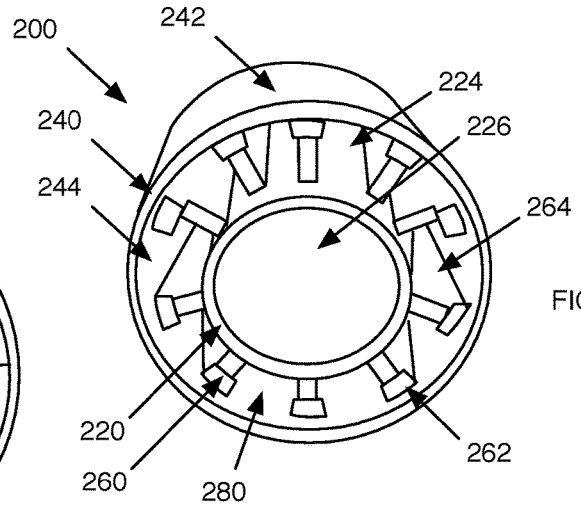
FIGS. 8, 9, 10, and 11 are perspective views of a first, second, third, and fourth variant of the shell, respectively.
Figure 10:
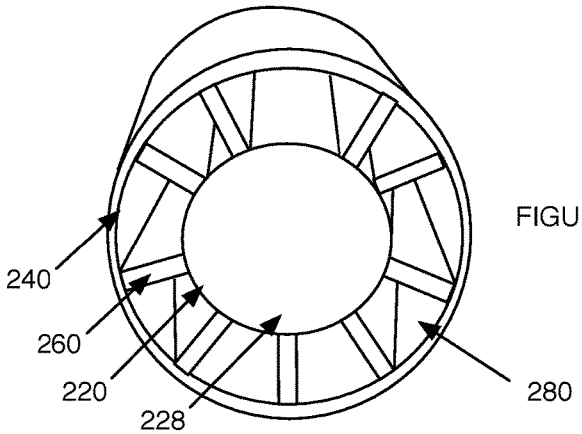
Figure 8:
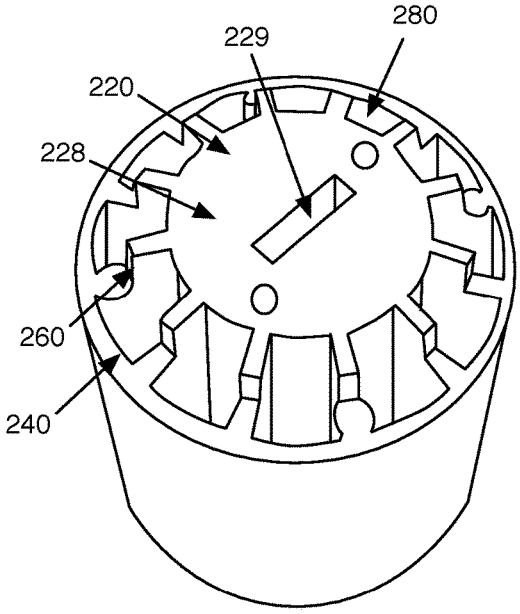
Figure 11:
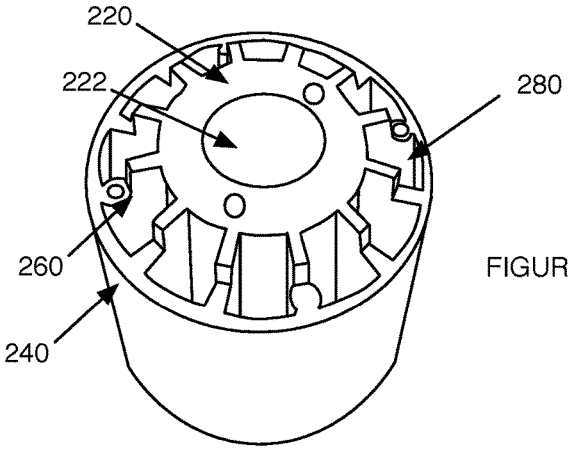
Figure 12:
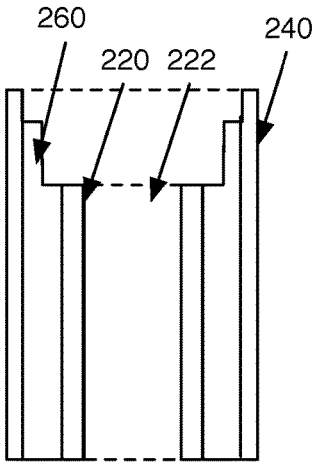
FIGS. 12, 13, and 14 are sectional views of a fifth, sixth, and seventh variant of the shell, respectively.
Figure 13:
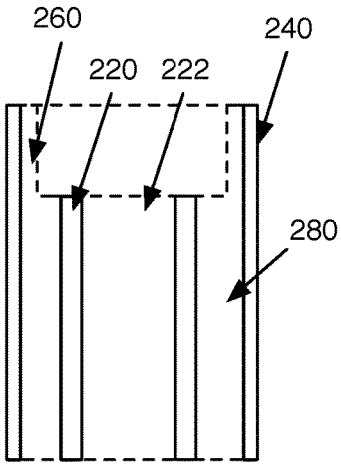

The inner wall 220 can additionally include an end cap 228 that functions to seal an end of the inner lumen 222, preferably the first end but alternatively the second end, as shown in FIG. 8 and FIG. 10. Alternatively, the inner lumen can remain substantially open along the first end, as shown in FIG. 9 and FIG. 11. The end cap 228 can additionally function to mount lighting assembly components, such as the lighting module 500, the diffuser 600, or any other suitable component. The end cap 228 can additionally function to thermally couple to heat-generating components, such as the circuit board 400, lighting module 500, or any other suitable component, and conduct heat from the components to the remainder of the shell 200. Alternatively, the inner lumen end can remain substantially open. The end cap 228 preferably extends across a first open end of the inner lumen 222 (e.g., the end opposing the insert insertion end), normal to the inner wall 220 or inner lumen longitudinal axis, such that the end cap 228 substantially seals the first open end. The end cap 228 can alternatively extend along a portion of the first open end, extend at an angle to the longitudinal axis, or be arranged in any other suitable configuration relative to the inner lumen 222. The end cap 228 is preferably thicker than the inner wall 220, but can alternatively be the same thickness or have any other suitable thickness. The end cap 228 is preferably an integral piece (singular piece) with the inner wall 220, but can alternatively be a separate piece that is permanently or removably retained along the inner wall end.

As shown in FIG. 8, the end cap 228 can include a first antenna aperture 229 through the cap thickness that functions to permit circuit board 400 extension therethrough. More preferably, the first antenna aperture 229 permits circuit board antenna extension through the end cap 228, but can alternatively permit any other suitable component extension therethrough. The first antenna aperture 229 can additionally function to retain and thermally couple to the circuit board 400. The first antenna aperture 229 can function to enable better signal receipt and/or transmission through the circuit board antenna by permitting the antenna 430 to extend beyond signal-interfering components, such as the shell 200. The first antenna aperture 229 can additionally function to thermally couple the end cap 228 and inner wall 220 to the circuit board 400 or any other component extending therethrough. The end cap 228 can additionally or alternatively include mounting points, such as screw holes, grooves, hooks, or any other suitable mounting point. Alternatively, the end cap 228 can be substantially continuous or have any other suitable configuration.

The fins 260 of the shell 200 function to increase the surface area of the shell 200 that is exposed to a cooling medium (e.g., air). The fins 260 can additionally function to cooperatively define the cooling channels 280. The fins 260 can additionally function to mechanically retain the position of the outer wall 240 relative to the inner wall 220. The fins 260 preferably extend radially outward from the inner wall 220 toward the outer wall 240. The fins 260 preferably connect with the outer wall 240 along all or a portion of the fin length, but can alternatively be disconnected from the outer wall 240. Alternatively, the fins 260 can extend radially inward from the outer wall 240 toward in the inner wall 220. The fins 260 preferably connect with the inner wall 220 along all or a portion of the fin length, but can alternatively be disconnected from the inner wall 220. However, the fins 260 can be otherwise configured. The fins 260 preferably extend along the longitudinal axis of the shell 200 (e.g., extend in parallel with the shell longitudinal axis), but can alternatively extend in a spiral about the shell longitudinal axis, extend perpendicular to the longitudinal axis, or extend in any other suitable configuration. The fins 260 are preferably evenly distributed about the inner wall 220 or outer wall 240, but can alternatively be unevenly distributed. The fins 260 can be distributed about the perimeter of the inner wall 220 or outer wall 240, the length of the inner wall 220 or outer wall 240, or along any other suitable portion of the shell 200. In a specific variation, the fins 260 are evenly distributed about the arcuate length of the inner wall perimeter. However, the fins 260 can be otherwise arranged.

Figure 19:
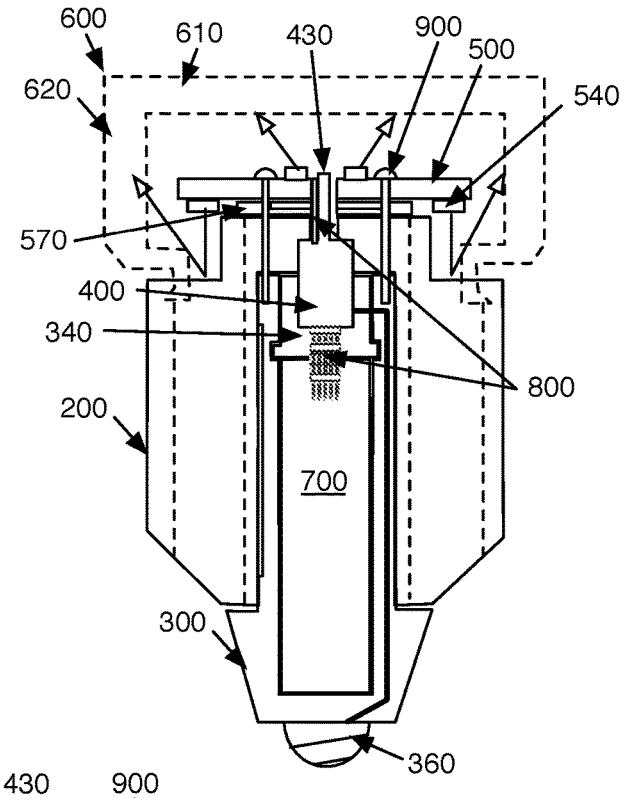

The fins 260 can be profiled along a first or second end to accommodate for protruding lighting arrangement components, such as light emitting elements 540 on the lighting module 500, diffuser wall, or any other suitable component. The profile can additionally or alternatively function as a mounting point for lighting assembly components, such as the diffuser. The profile can additionally or alternatively function as a diffuser or reflector for the light emitting elements 540, such as when the lighting module 500 is arranged proximal or directed toward the fins 260, as shown in FIG. 19. The fins 260 can additionally or alternatively have profiled broad faces, or have any other suitable configuration. The fin profile is preferably stepped with an elevated and a lowered portion, but can alternatively be ogived, ogeed, or have any other suitable shape. The elevated portion of the fin can be arranged proximal the inner wall 220, proximal the outer wall 240, between the inner and outer walls, or arranged in any other suitable position. The lowered portion of the fin can be arranged proximal the outer wall 240, proximal the inner wall 220, between the inner and outer walls, or arranged in any other suitable position. In a first variation, as shown in FIG. 8 and FIG. 11, the profiled fins form a recess along the shell perimeter, with an elevated portion proximal the inner wall 220 and lowered portion proximal the outer wall 240. The outer wall 240 can be shorter than inner wall 220 along longitudinal axis, longer than the fin length (e.g., such that the outer wall 240 protrudes beyond the fin end), or have any other suitable length. In a second variation, as shown in FIGS. 9, 12, 13, and 14, the profiled fins form a recess along the shell interior, with an elevated portion proximal the outer wall 240 and lowered portion proximal the inner wall 220. The inner wall 220 can be shorter than outer wall 240 along longitudinal axis, longer than the fin length (e.g., such that the inner wall 220 protrudes beyond the fin end), or have any other suitable length.

The outer wall 240 of the shell 200 functions to cover the fins 260 to smooth out the housing exterior, which lends to a minimalistic aesthetic. The outer wall 240 can function to prevent contaminant (e.g., dust, cobwebs, etc.) buildup between the fins 260 that would otherwise thermally insulate the lighting assembly 100. The outer wall 240 can function to cooperatively form enclosed cooling channels 280 with the inner wall 220 and adjacent fins 260, which can function to facilitate natural convection through the shell 200. The outer wall 240 can function to dissipate heat from the fins 260 to a cooling medium. The outer wall 240 can function to cooperatively define the cooling channels 280. The outer wall 240 can function to support the fins 260, function as a mounting point for lighting assembly components, such as the lighting module 500 or diffuser 600, or function in any other suitable manner. The outer wall 240 can include an exterior surface 242 distal the inner wall 220 and an inner surface proximal the inner wall 220. The outer wall 240 is preferably thermally conductive, but can alternatively be thermally insulative, more or less thermally conductive than the fins 260 or inner wall 220, or have any other suitable thermal property.

Figure 20:
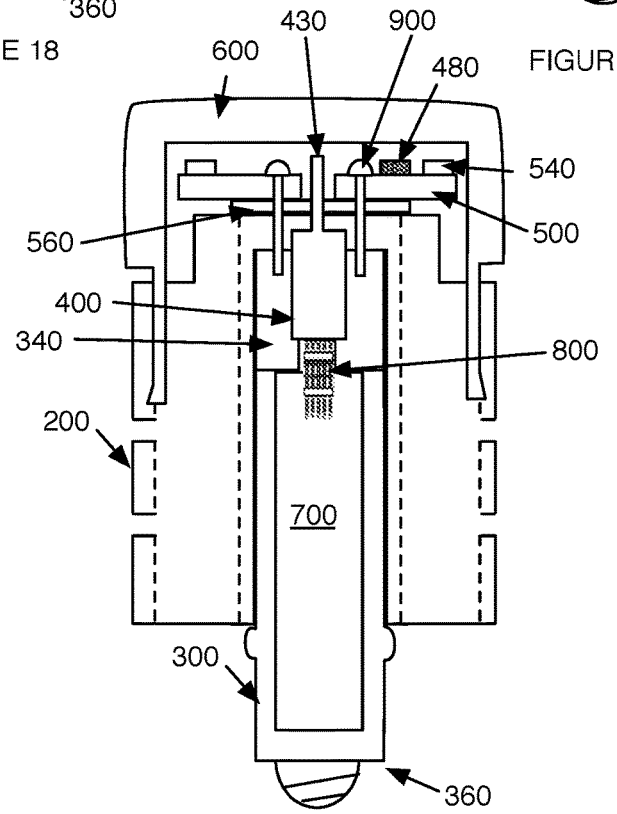

The outer wall 240 is preferably tubular, but can alternatively be spherical, profiled or have any other suitable configuration. The outer wall exterior cross section is preferably substantially similar to the inner wall cross section, but can alternatively be different. The outer wall 240 can be cylindrical, with an ovular or circular cross section, have a square cross section, a triangular cross section, octagonal cross section, or have any other suitable cross section. In one variation, the outer wall 240 can include a cylindrical section having a first diameter proximal the first shell end, wherein the outer wall 240 is angled and tapers toward the inner wall diameter proximal the second shell end. However, the outer wall 240 can include any other suitable longitudinal section profile. The outer wall 240 preferably includes a longitudinal axis along its length. The length of the outer wall 240 can be substantially similar to the length of the inner wall 220, longer than the inner wall 220, shorter than the inner wall 220, similar to the length of the fin portion adjoining the outer wall 240, or have any other suitable length. The outer wall thickness is preferably substantially similar to that of the inner wall 220, but can alternatively be thicker, thinner, or have any other suitable configuration. The outer wall thickness is preferably substantially constant, but can alternatively vary along its length, vary along different angular sections, or vary in any other suitable manner. The outer wall 240 is preferably substantially continuous, but can alternatively include apertures through the outer wall thickness (e.g., cooling features), as shown in FIG. 20, or any other suitable feature.

The outer wall 240 preferably defines a lumen, wherein the inner wall 220 and fins 260 are preferably arranged within the lumen. The outer wall 240 preferably encircles the inner wall 220, but can alternatively encompass an arcuate portion of the inner wall 220, a portion of the inner wall length, or any other suitable portion of the inner wall 220. The outer wall 240 is preferably coaxially arranged with the inner wall 220 (e.g., wherein the outer wall longitudinal axis is substantially aligned with the inner wall longitudinal axis), but can alternatively be coaxially arranged with the end cap 228, coaxially arranged with the insert, offset from the inner wall 220, end cap 228, insert, or any other suitable component. The outer wall 240 and inner wall 220 are preferably concentrically arranged, but the outer wall 240 can be otherwise arranged relative to other lighting assembly components.

The shell 200 can additionally define a set of cooling channels 280 (fluid flow paths, fluid channels) that function to permit cooling fluid flow therethrough. The cooling channels 280 are preferably enclosed along their lengths and tubular, such that the channels facilitate natural convection. However, the cooling channels 280 can alternatively be partially open along their lengths (e.g., groove-like or crenulated) or have any other suitable configuration. The cooling fluid is preferably gaseous, but can alternatively be liquid. The cooling fluid can be air (e.g., from the ambient environment), water, coolant, phase change material, or any other suitable cooling fluid. The cooling channels 280 are preferably cooperatively defined by the inner wall 220, the outer wall 240, and a first and second adjacent fin, but can alternatively be defined by an insert, a through hole formed within the inner wall 220, within the outer wall 240, within the fin, or defined in any other suitable component. The cooling channel walls can be smooth or textured (e.g., includes bumps, divots, grooves, protrusions, etc.).

The cooling channels 280 preferably include an inlet and an outlet, but can alternatively include a single opening, multiple openings, or any other suitable number of openings. The inlet is preferably defined by voids cooperatively formed by the ends of the inner wall 220, outer wall 240, and a first and second adjacent fin at a first or second end of the shell 200, but can alternatively be defined by apertures through inner wall 220, outer wall 240, fin, or other shell component. The outlet is preferably defined by voids cooperatively formed by the ends of the inner wall 220, outer wall 240, and a first and second adjacent fin at a first or second end of the shell 200, but can alternatively be defined by apertures through inner wall 220, outer wall 240, fin, or other shell component. In one variation, the cooling channel is substantially linear and extends in parallel with the shell longitudinal axis. In a second variation, the cooling channel inlet arranged at a first end of the shell 200 (e.g., proximal the end cap 228 or distal the end cap 228) and cooperatively defined by the inner wall 220, outer wall 240, and a first and second adjacent fin, the cooling channel body extends along a length of the shell 200, and the cooling channel outlet extends through an aperture in the outer wall 240.

Figure 7:
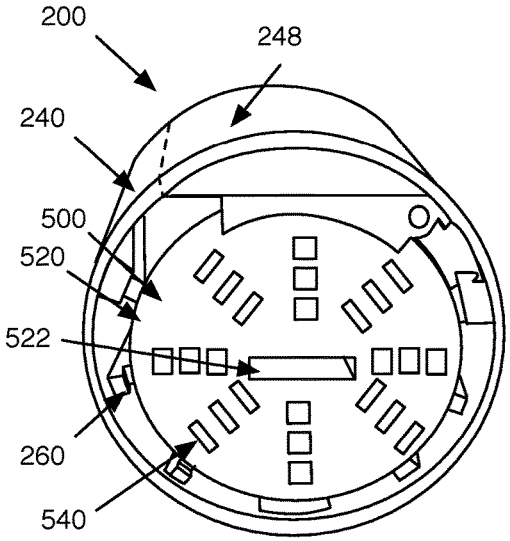
FIG. 7 is a perspective view from an end of a variation of the shell including a lighting module mounted to the end and a circuit board mounted between the inner and outer walls.
Figure 14:
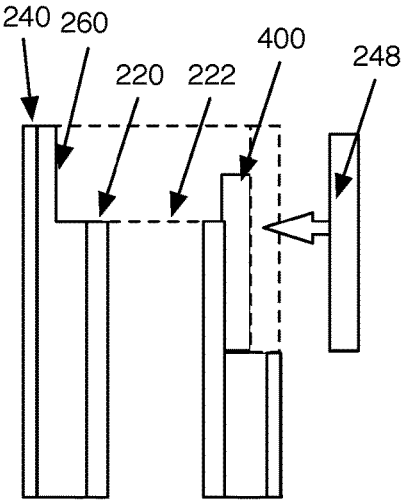

As shown in FIGS. 1, 7, and 14, the shell 200 can additionally define a circuit board mounting portion. The circuit board mounting portion is preferably defined within the lumen defined between the inner and outer walls, but can alternatively be defined within the inner lumen 222, defined external the outer wall 240, or defined in any other suitable position. The circuit board mounting point can be defined by a lack of fins 260, profiled fins (e.g., wherein the fins 260 are profiled to provide a void for the circuit board 400), or be defined in any other suitable manner. The circuit board 400 can be mounted to the inner wall exterior surface, the outer wall interior surface 244, a broad face of a fin, an end of the inner wall 220, an end of the outer wall 240, an end 262 of one or more fins, and/or to any other suitable surface. When the circuit board mounting portion is defined between the inner and outer walls, the shell 200 can additionally include an access point 246 that enables user access to the circuit board 400. The access point 246 is preferably an aperture in the outer wall 240, but can alternatively be any other suitable access point. The access point 246 is preferably removably sealable with a door or cover 248, but can alternatively remain open or have any other suitable configuration. The circuit board mounting portion preferably opposes the access point (e.g., is radially aligned with the access point), but can alternatively be offset from the access point or arranged on the access point cover. However, the shell 200 can include any other suitable circuit board mounting point.

The insert 300 of the housing assembly no of the lighting assembly 100 functions to support the power supply unit, support the circuit board 400, provide an electrical connection to a primary power source, electrically connect powered lighting assembly components to the primary power source, thermally insulate the power supply unit from the shell 200, thermally insulate the power supply unit, circuit board 400, and/or the lighting module 500 from the base 360, thermally couple the power supply to the shell 200, and/or have any other suitable functionality. The insert 300 is preferably thermally insulative (e.g., has a thermal conductivity of less than 10 W/mK, less than 5 W/mK, less than 1 W/mK, less than 0.2 W/mK, etc.), but can alternatively be thermally conductive, wherein the insert 300 can have substantially the same thermal conductivity as the shell 200, a higher thermal conductivity than the shell 200, a lower thermal conductivity than the shell 200, or have any other suitable thermal property. The insert 300 can be made from plastic (e.g., a polymer), ceramic, organic material (e.g., paper), or any other suitable material. The plastic can be thermally insulative (e.g., be a thermoplastic or thermoset, such as polysulfone, PEET, or any other suitable thermally insulative plastic) or thermally conductive. Examples of thermally conductive plastics are discussed above. The plastic can be electrically insulative or electrically conductive. The insert material can be the same material as the shell or a different material from the shell. The insert 300 is preferably a separate piece from the shell 200, but can alternatively be an integral (singular) piece with the shell 200.

The insert 300 preferably couples within the inner lumen 222 defined by the inner wall 220, wherein the insert 300 preferably includes keying features on the insert exterior that are complimentary to the keying features on the inner lumen 222, but can alternatively be smooth or have any other suitable configuration. The insert 300 is preferably removably coupled to the inner lumen 222, but can alternatively be permanently coupled (e.g., with adhesive, etc.) or otherwise coupled. The insert 300 can include coupling features that couple to complimentary features within the inner lumen 222, or can be coupled by a separate component or coupled in any other suitable manner. Coupling features can include complimentary threading, grooves, hooks, or any other suitable coupling mechanisms. The coupling features are preferably arranged on the insert exterior, but can alternatively be arranged on the insert interior. The insert 300 can alternatively or additionally be coupled to the shell 200 by a coupling mechanism of a separate lighting assembly component. In one variation, the lighting module 500 coupling to the shell 200 can also retain the insert position within the inner lumen 222. For example, screws retaining the lighting module 500 to the end cap 228 can extend through the end cap 228 to the insert 300 to retain the insert position within the inner lumen 222. However, the insert position can be otherwise retained relative to the shell 200.

The insert 300 preferably includes an exterior surface, and defines a first and second end. The insert 300 is preferably configured to be inserted with the first end proximal the end cap 228 (e.g., the first end of the inner lumen 222), but can alternatively be configured to be inserted with the second end proximal the end cap 228, or be configured to be inserted in any other suitable manner. In a first variation, the insert 300 includes a first and second opposing open end. In a second variation, the insert 300 includes a first open end and a second closed end opposing the first end. However, the insert 300 can have any other suitable configuration.

Figure 15:
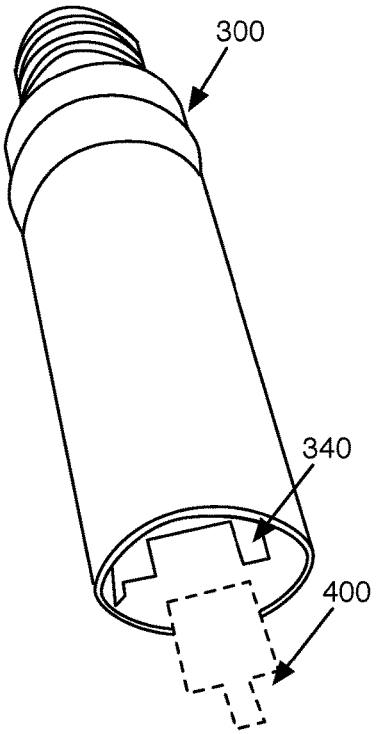
FIGS. 15 and 16 are perspective views of a first and second variant of the insert, respectively.
Figure 16:
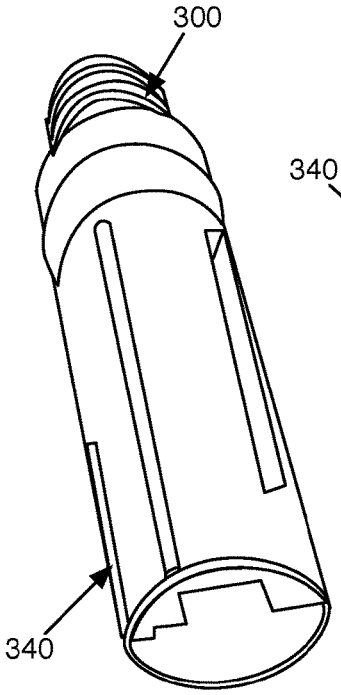

The cross section of the insert exterior perimeter preferably substantially mirrors the inner lumen cross section, but can alternatively be different. The insert 300 preferably fits within the inner lumen 222 with a free-running fit, but can alternatively fit with a friction fit or any other suitable fit. The insert 300 can be cylindrical, as shown in FIGS. 15 and 16, with an ovular or circular cross section, have a square cross section, a triangular cross section, octagonal cross section, or have any other suitable cross section. In one variation, the insert 300 is substantially smooth along its length. In a second variation, the insert 300 includes a set of protrusions extending arcuately about the insert perimeter. The set of protrusions are preferably configured to be arranged proximal the second end of the shell 200 (e.g., end of the shell 200 distal the end cap 228), but can alternatively be arranged in any other suitable position. The set of protrusions can function to partially block or form a tortuous path to the cooling channel inlet or outlet, function as a stopping element that prevents further insert 300 insertion into the inner lumen 222, or serve any other suitable function. The protrusions can be rounded, include edges, or have any other suitable profile. However, the insert 300 can include any other suitable external features. The insert 300 preferably includes a longitudinal axis along its length. The length of the insert 300 is preferably longer than the length of the inner lumen 222, such that the insert 300 extends beyond the shell end, but can alternatively be longer than the shell 200, the inner wall 220, the outer wall 240, the fins 260, or any other suitable portion of the lighting assembly 100.

In one variation, an air gap is maintained between the insert 300 and inner wall 220 about a substantial portion of the insert external surface to further thermally insulate the insert 300 and contained components from the shell 200. In this variation, the insert 300 or inner lumen 222 preferably includes a standoff that maintains the air gap. However, the air gap can be otherwise maintained. In a second variation, the insert 300 can physically contact the inner wall 220 along a substantial portion of the insert external surface (e.g., radial surface). In this variation, the insert 300 can be thermally insulative or thermally conductive, wherein physical contact between the insert 300 and inner wall 220 preferably forms a thermal connection between the insert 300 and shell 200.

The insert 300 can additionally define a power supply lumen and include an interior surface. Alternatively, the insert 300 can exclude a power supply lumen and be substantially solid. Alternatively, the insert 300 can be the power supply unit, or be any other suitable component of the lighting assembly 100. The power supply lumen preferably extends along a portion of the insert length, but can alternatively extend along the entirety of the insert length or be defined in any other suitable portion of the insert. The power supply lumen is preferably concentric with the insert, wherein the power supply lumen longitudinal axis is substantially aligned with the insert longitudinal axis, but can alternatively be offset, perpendicular, or otherwise arranged. The power supply lumen is preferably arranged proximal the second end of the insert, but can alternatively be arranged along the center of the insert length, proximal the first end of the insert, or arranged in any other suitable position. The power supply lumen can permanently retain the power supply, transiently or removably retain the power supply, or otherwise retain the power supply. The power supply lumen can include power supply retention mechanisms, such as threading, clips, cap retention mechanisms (e.g., grooves), or any other suitable retention mechanism.

The insert 300 can additionally include a circuitry plate that functions to mechanically support the circuit board 400. Alternatively, the insert 300 can exclude a circuitry plate. The circuitry plate can additionally function to thermally couple to the circuit board 400 and transfer (conduct) heat 102 from the circuit board 400 to the shell 200 (e.g., the inner wall 220), the insert 300, or any other suitable housing assembly 110 or lighting assembly component. The circuitry plate can additionally function to retain the position of the power supply unit within the insert. The circuitry plate preferably retains the circuit board 400 such that the circuit board 400 extends beyond the end (e.g., first end) of the insert, but can alternatively retain the circuit board 400 within the boundaries of the insert, retain the circuit board 400 such that the circuit board 400 is partially encompassed by the insert 300 (insert body), or retain the circuit board 400 in any other suitable manner.

The circuitry plate preferably extends across a power supply lumen cross section. The circuitry plate preferably extends along a longitudinal axis of the power supply lumen, but can alternatively extend across the power supply lumen cross section (e.g., normal to the longitudinal axis), at an angle to the longitudinal axis, or extend along any other suitable portion of the power supply lumen. For example, the circuitry plate can extend along a chord of the power supply lumen, such as across the diameter of the power supply lumen. The circuitry plate is preferably arranged proximal the first end of the insert, but can alternatively be arranged proximal the second end of the insert, arranged along the middle of the insert length, or arranged in any other suitable portion of the insert.

In a first variation, the circuitry plate can be thermally insulative. The circuitry plate can be plastic, ceramic, or any other suitable material. The circuitry plate is preferably the same material as the insert, but can alternatively be a different material. The circuitry plate can be formed as a singular piece with the insert 300 when the insert 300 is also thermally insulative, be a secondary insert 300 within the insert, or have any other suitable configuration.

In a second variation, the circuitry plate can be thermally conductive, wherein the circuitry plate conducts heat from the circuit board 400 to the insert, if thermally conductive, and/or the shell 200, wherein the circuitry plate can extend through the insert walls to the insert exterior and/or inner wall 220 (e.g., if the insert 300 is thermally insulative) as shown in FIG. 16. In this variation, the circuitry plate can be formed as an integral (singular) piece with the insert, be a separate piece from the insert 300 (e.g., be a secondary insert), or have any other suitable construction.

In a third variation, the circuitry plate can be both thermally conductive and thermally insulative. In one example, the circuitry plate can include a first portion configured to extend substantially perpendicular to the insert longitudinal axis and retain the power supply lumen, and a second portion configured to extend substantially parallel to the insert longitudinal axis and retain the circuit board 400. The first portion can be thermally insulative, and the second portion can be thermally conductive. However, the circuitry plate can be otherwise configured.

Figure 17:
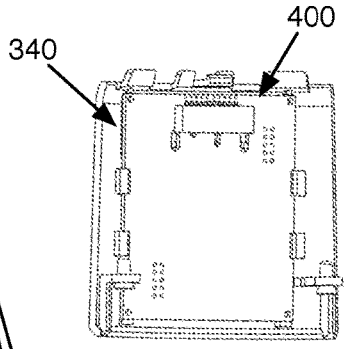
FIG. 17 is a view of the circuit board coupled to a variation of the circuit plate.

The circuitry plate can additionally include circuit alignment features configured to align circuit board insertion into the circuitry plate, AS SHOWN IN FIG. 17. The circuit alignment features can be grooves, clips, keying features (e.g., asymmetric groove and protrusion combination), clips, or any other suitable alignment feature. In one variation, the alignment feature can be a protrusion or groove extending along a longitudinal portion of the insert body.

The circuitry plate can additionally include mounting features configured to retain the circuit board position within the circuitry plate. The mounting features can be arranged within the alignment features, at the end of the alignment features, independent of the alignment features, or arranged in any other suitable position. The mounting features can include clips, grooves, hooks, adhesive, screw holes, or any other suitable mounting feature.

The insert 300 can additionally include a base 360 that functions to electrically and mechanically couple the lighting assembly 100 to a primary power source. The primary power source can be an electric grid (e.g., a power transmission grid), a renewable power system (e.g., a solar or wind energy harvesting system), or any other suitable external power source. The base 360 is preferably configured to couple to a socket 10, such as a lighting fixture socket, but can alternatively be configured to couple to any other suitable mounting point. The base 360 is preferably a lightbulb base, but can alternatively be any other suitable electric connector 800. The base 360 is preferably a standard base, but can alternatively be non-standard. Examples of the base include an Edison screw base, bayonet style base, bi-post, bi-pin connector, wedge base, flourescent tubular lamp standards (e.g, T-5 mini, T-5 medium, T-12 large), or any other suitable base. The base 360 is preferably arranged along the second end 112 of the lighting assembly or the second end of the insert, distal the end configured to be proximal the first end of the inner lumen 222 or end cap 228, but can alternatively be arranged along any other suitable portion of the insert. The base 360 preferably substantially seals the insert end, but can alternatively partially seal the insert end (e.g., for heat removal and/or thermal convection purposes) or be otherwise arranged relative to the insert. The base 360 can be formed as an integral piece of the insert, mounted to the insert 300 (e.g., by adhesive, soldering, welding, screwing into the insert 300 end, or any other suitable technique), or otherwise physically coupled to the insert.

Figure 18:
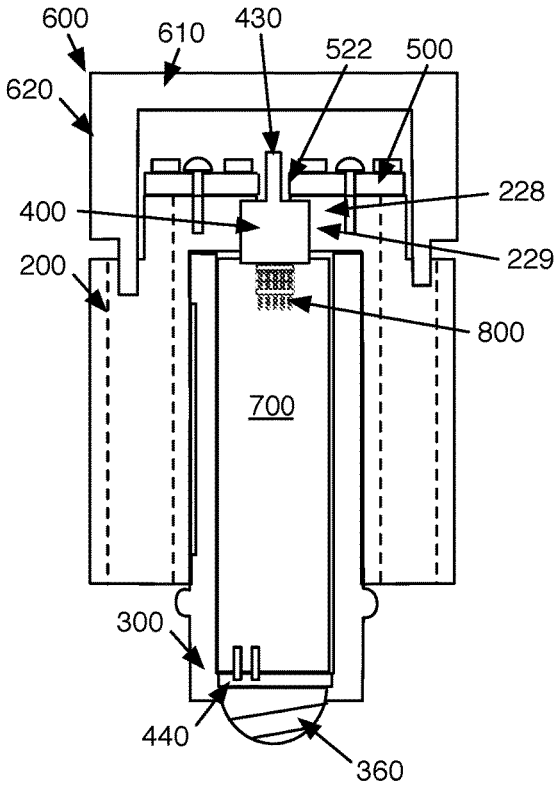
FIGS. 18, 19, 20, 21, 22, and 23 are sectional views of a first, second, third, fourth, fifth, and sixth variation of the lighting assembly, respectively.

The lighting assembly 100 can additionally include a power conversion circuit 440 that functions to convert primary power 40 from the primary power source to power suitable for the power supply unit, circuit board 400, and/or lighting module 500. The power conversion circuit 440 is preferably arranged on the circuit board 400, but can alternatively be arranged on a separate circuit board 400 and located between the power supply unit and base 360 (as shown in FIG. 18), arranged on the circuit plate 340, within the insert, or in any other suitable location within the lighting assembly 100.

The insert 300 can define leads from the base 360 to the power conversion circuit 440, wherein the insert 300 can include electrically conductive portions imbedded within the insert walls and/or circuit plate 340. Alternatively, the insert 300 can guide wires from the base 360 to the power conversion circuit 440, wherein the insert 300 can include channels or grooves extending between the base 360 and the power conversion circuit location. However, the power conversion circuit 440 can be otherwise connected to the base 360.

Figure 5:
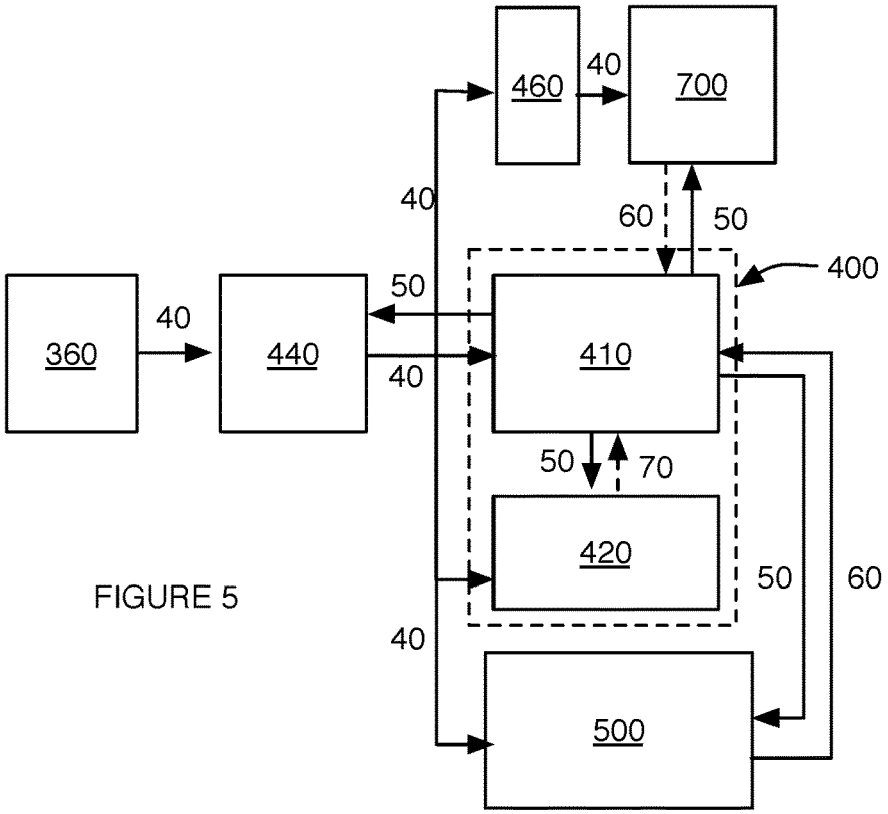
FIG. 5 is a schematic representation of a variation of the lighting assembly circuitry and power and data transfer between the components.
Figure 6:
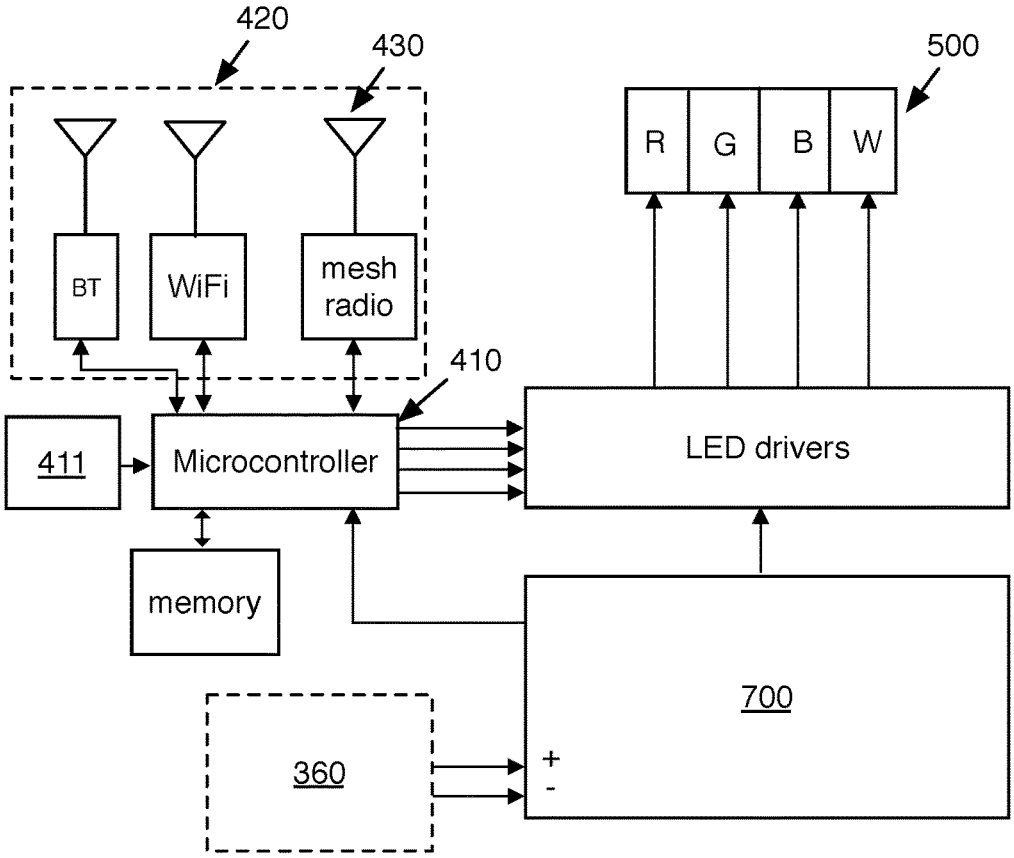
FIG. 6 is a schematic representation of a variation of the lighting assembly circuitry.

The power conversion circuit 440 is preferably electrically connected between the base 360 and the lighting assembly component, but can alternatively be connected in any other suitable configuration. In a first variation, the power conversion circuit 440 is electrically connected between the base 360 and the power supply unit, wherein the power supply unit conditions the power for the lighting module 500 and/or circuit board 400. In a second variation, the power conversion circuit 440 is electrically connected between the base 360 and the circuit board 400, as shown in FIG. 5, wherein the power conversion circuit 440 converts primary power into circuit board power, and the circuit board 400 selectively controls power provision to the lighting module 500 and power supply unit. However, primary power can be otherwise routed through the lighting assembly 100.

The circuit board 400 of the lighting assembly 100 includes a processor 410, and can additionally include a communication module 420. The circuit board 400 can function to support the processor 410 and communication module 420, or can be the processor 410 and/or communication module 420. The circuit board 400 is preferably retained by the insert, but can alternatively be retained by the shell 200, such as an exterior surface of inner wall 220, interior surface of the outer wall 240, ends of the inner wall 220, outer wall 240, or fins 260, broad face 264 of the fins 260, the lighting module 500, or any other suitable mounting point. The circuit board 400 preferably thermally contacts a thermally conductive housing component, such as the shell 200, more preferably the end piece or inner wall 220, but can alternatively thermally contact any other suitable component.

The circuit board 400 preferably extends beyond the shell 200, but can alternatively be entirely encompassed by the shell 200. The circuit board 400 preferably extends beyond the lighting module 500, but can alternatively terminate at a point between the lighting module 500 and base 360, second shell end, or second housing end. More preferably, the circuit board 400 antenna extends beyond the end cap 228 or lighting module 500, wherein the remainder of the circuit board body is retained within the boundaries of the shell 200, inner wall 220, inner lumen 222, or within the boundaries defined by any other suitable housing component. However, the circuit board 400 can be otherwise arranged.

The circuit board 400 is preferably substantially planar, with a first and second broad face, but can alternatively be profiled or have any suitable shape. The circuit board 400 can be arranged with a longitudinal axis substantially parallel with the shell 200 or insert longitudinal axis, but can alternatively be arranged with the longitudinal axis substantially perpendicular with the shell 200 or insert longitudinal axis, or be arranged in any other suitable orientation. In one example, the circuit board 400 can be curved, wherein a broad face of the circuit board 400 is configured to couple to the curved radial surface of the inner or outer wall. In a second example, the circuit board 400 can be toroidal, and rest along the fin ends between the inner and outer walls. In a third example, the circuit board 400 can be substantially planar and rectangular, and sit within the power supply lumen defined by the insert. However, the circuit board 400 can be otherwise configured and otherwise arranged.

The circuit board 400 is preferably electrically connected to the lighting module 500. The circuit board 400 can be electrically connected to the lighting module 500 by solder, a set of complimentary electrical connectors, a wire, or any other suitable electrical connection. The circuit board 400 is preferably electrically connected to the power supply unit. The circuit board 400 can be electrically connected to the power supply unit by solder, a set of complimentary electrical connectors (e.g., standard connectors, such as microUSB, or nonstandard connectors), a wire, or any other suitable electrical connection. The electrical connection can be keyed or unkeyed. In one variation, the circuit board 400 includes the male connector of a complimentary connector pair, while the power supply unit or lighting module 500 includes the female connector. Alternatively, the circuit board 400 can include the female connector of the complimentary connector pair, a set of exposed electrodes, or any other suitable connection.

The processor 410 of the circuit board 400 functions to control lighting module operation based on stored settings, settings received from the communication module 420, or any other suitable setting. The processor 410 can additionally function as the power conversion module, the power regulation module (e.g., wherein the processor 410 selectively controls power transfer between the base 360, the power supply unit, the circuit board 400, and lighting module 500), or perform any other suitable functionality. As shown in FIG. 5, the processor 410 can additionally function to generate control information 50 for the power supply unit 700, lighting module 500, communication module 420, and/or any other suitable lighting assembly component. Examples of control information 50 include the power state of the component (e.g., whether the communication module 420 should be on or off, which communication system within the communication module 420 should be on or off, etc.), the targeted operation state of the component (e.g., whether the communication module 420 should be in a high power mode or low power mode, whether the lighting module 500 should be in a high power mode or a low power mode, etc.), or any other suitable control instruction. The processor 410 can additionally function to receive operation information 60 from the power supply, lighting module 500, communication module 420, and/or any other suitable lighting assembly component, and control the respective component or another component based on the operating information. Examples of operation information 60 include the instantaneous component operation parameters (e.g., light emitting element current, voltage, pulse frequency; power supply state of charge, etc.), sensor 480 measurements, or any other suitable information indicative of a past, instantaneous, or future operation state for the component. The processor 410 can additionally be electrically connected to a reset switch 411 that functions to restart the processor 410, set a processor 410 operation mode, or control the processor 410 in any other suitable manner. The reset switch 411 can be accessible from the outer wall exterior surface, accessible through an outer wall aperture, or accessible in any other suitable manner. The reset switch 411 can be a mechanical switch, magnetic switch, or any other suitable switch.

The communication module 420 of the circuit board 400 functions to receive information 70 from a secondary computing device (peripheral devices), and can additionally function to transfer information to a secondary computing device. The communication module 420 preferably communicates with the processor 410, but can alternatively communicate with any other suitable lighting assembly component. The communication module 420 can additionally function to process the information, such as encrypting or decrypting the information, compressing or decompressing the information, or processing the information in any other suitable manner. Alternatively, these functionalities can be performed by the processor 410 or another circuit. The communication module 420 can additionally function as a wireless signal amplifier, such as a Wi-Fi repeater.

Figure 26:
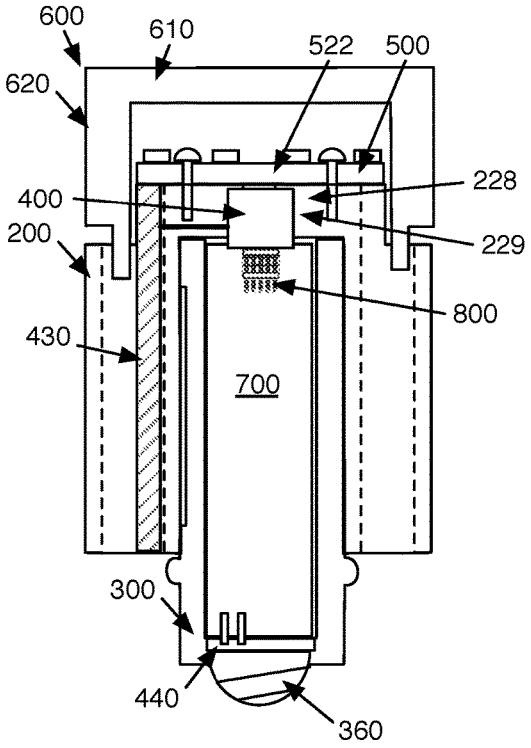
FIGS. 26, 27, 28, 29, and 30 are schematic representations of a first, second, third, fourth, and fifth variation of the lighting assembly including integrated antennae.
Figure 27:
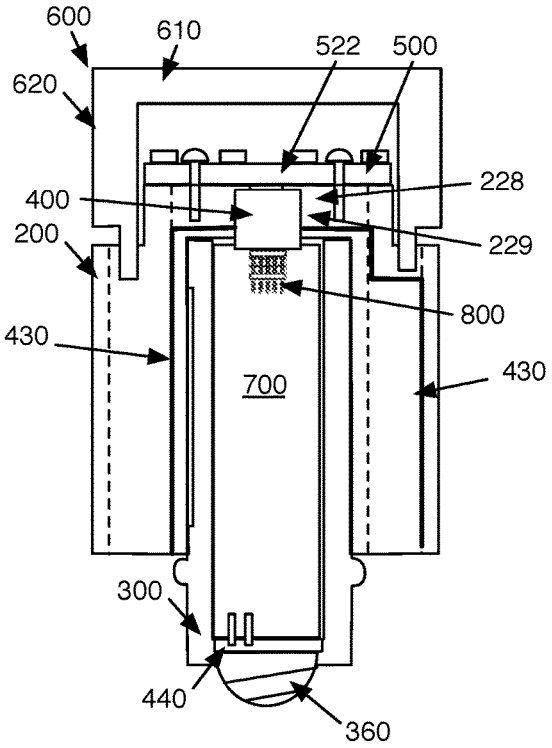
Figure 28:
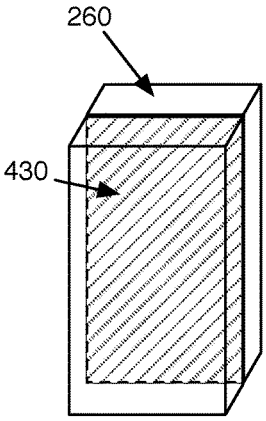
Figure 29:
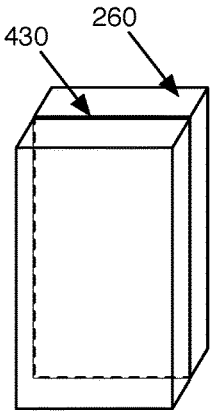
Figure 30:
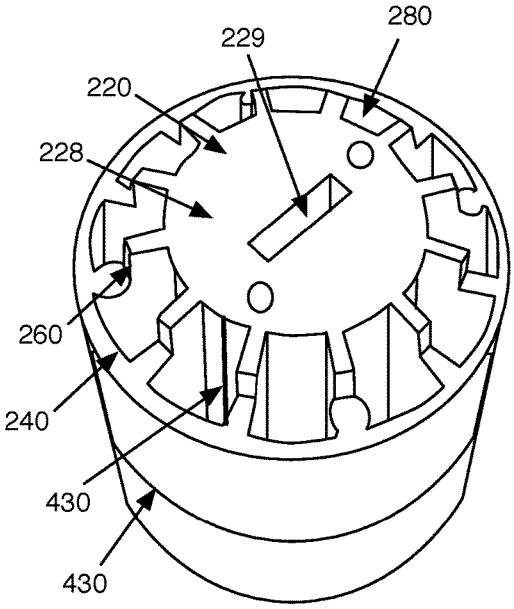

The communication module 420 is preferably a chip including one or more antennae 430, but can alternatively have any other suitable form factor. The antennae function to communicate data to and/or from the chip, and can additionally function to transfer and/or receive power from a peripheral device. The set of antennae 430 preferably extend from the communication module 420, more preferably from the circuit board 400, but can alternatively be integrated into the communication module 420, integrated into the board, integrated into the shell, or otherwise configured. When the lighting assembly 100 is assembled, the antenna 430 preferably extends beyond the shell end to enable better signal reception and/or reduce signal interference by the housing material. The antenna 430 can additionally extend through the diffuser 600, or can be enclosed by the diffuser 600. The antenna 430 preferably extends through antenna apertures in the end cap 228 and/or the lighting module 500, but can alternatively extend through a gap between the end cap 228 and/or lighting module 500 and shell 200, or extend through any other suitable aperture. Alternatively, the antenna 430 can be confined within the shell boundaries by the shell 200 (e.g., by the end cap 228), by the lighting module 500, or by any other suitable component. In this variation, the shell 200, lighting module 500, or other enclosing component can function to shield the circuit board 400 or communication module 420 from EMI emissions from external electrical components. Alternatively, the antenna 430 can be substantially integrated into or extend along a portion of the housing. In one variation, one or more antennae extend along the perimeter (e.g., as shown in FIG. 28) or a cross section (e.g., as shown in FIG. 29) of the fin (e.g., along the thickness, along a fin broad face, along a fin end, along the fin interior, substantially parallel a fin broad face, etc.), wherein each fin can include one or more antennae. Alternatively, one or more antennae can extend along the perimeter of the shell or insert (e.g., outer wall edge, inner wall edge, inner or outer wall interior or exterior surface, etc.) in a plane perpendicular to or at an angle to a shell longitudinal axis (e.g., as shown in FIG. 30), along the length of the shell or insert (e.g., substantially parallel the longitudinal axis, as shown in FIGS. 30, 26, and 27), or along any other suitable portion of the housing. The integrated antenna can be inserted into or coupled to the housing after housing manufacture, formed with the housing, or otherwise coupled to the housing. The integrated antenna can be coupled to the communication module prior to communication module coupling to the housing, can be coupled to the housing prior to communication module coupling to the housing, wherein communication module coupling to the housing also connects the antenna to the communication module through integrated or separate wires, or otherwise coupled to the communication module.

The communication module 420 can be a wireless communication module 420, wireless communication module 420 and/or any other suitable communication module 420. The wireless communication module 420 can be a short-range communication module 420, a long-range communication module 420, and/or any other suitable communication module 420. The wireless communication module 420 can enable a single communication standard, or can enable multiple communication standards. Examples of short-range communication technologies include NFC, RF, IR, Bluetooth, Zigbee, mesh networking, beacon, or Z-wave, but any other suitable short-range communication technology can be used. Examples of long-range communication technologies include cellular, WiFi (e.g., single or multiple band Wi-Fi), ultrasound, or IEEE 802.22, but any other suitable long-range communication technology can be used.

The circuit board 400 can additionally function to store lighting assembly settings (e.g., lighting module 500 operation settings, lighting assembly identifier, associated user information, etc.), wherein the circuit board 400 can additionally include memory. The memory is preferably digital memory, such as flash memory or RAM, but can alternatively be any other suitable type of memory.

The circuit board 400 can additionally include a set of heatsinks (one or more heatsinks) that thermally couple to the chips on the circuit board 400. The heatsinks can thermally couple to the insert, such as to the insert wall or to the circuit plate 340, thermally couple to the shell 200, such as to the inner wall 220 or outer wall 240, or to any other suitable housing assembly component.

Figure 22:
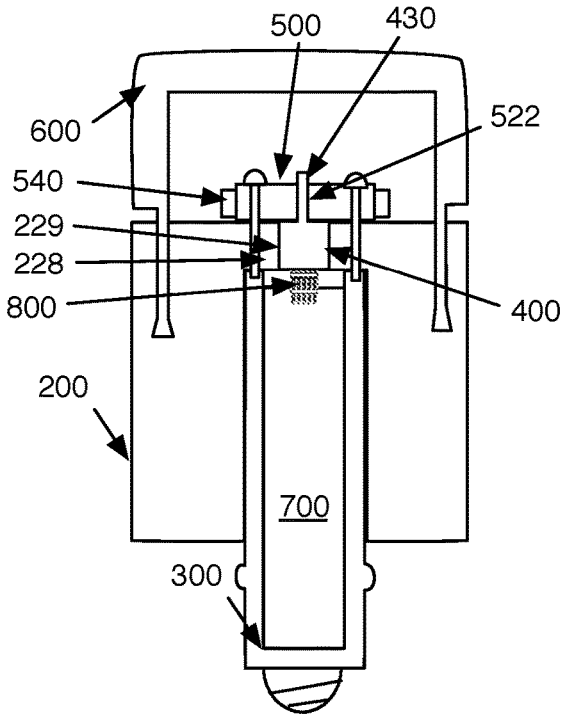
Figure 23:
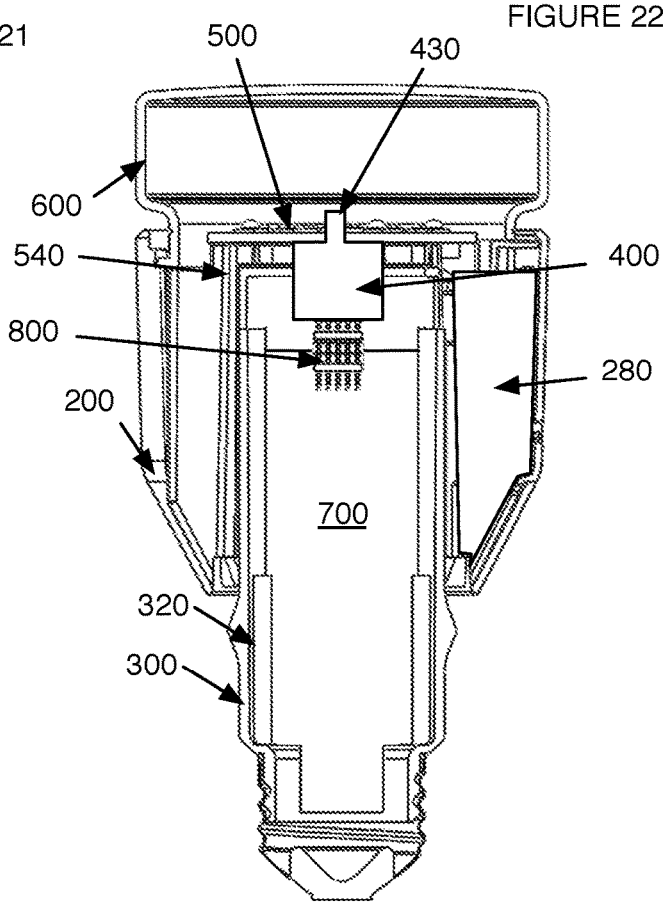
Figure 24:
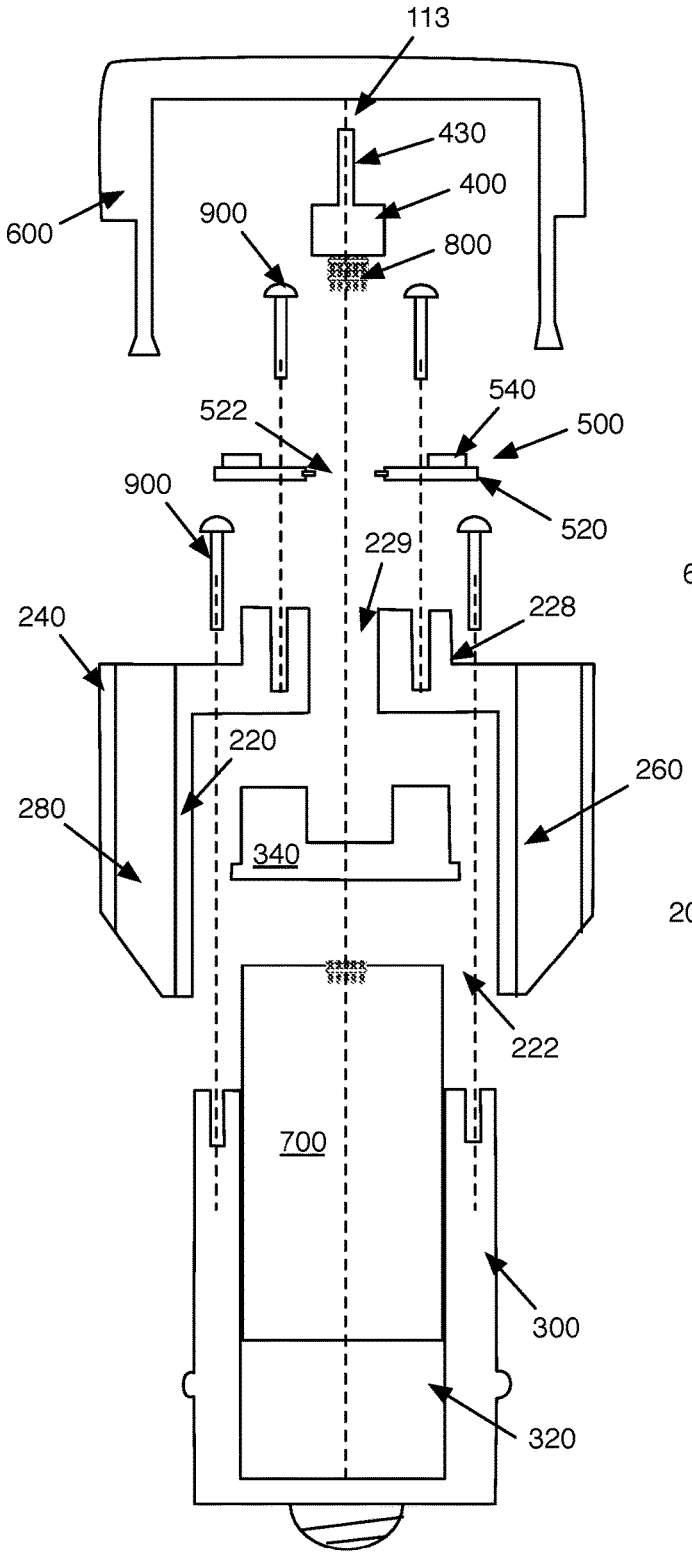
FIG. 24 is an exploded view of a variant of the lighting assembly.

The lighting module 500 of the lighting assembly 100 functions to emit light 30 based on instructions received from the circuit board 400 (e.g., from the processor 410). The lighting module 500 can include a substrate 520 and a set of light emitting elements 540 mounted to the substrate 520. The substrate 520 preferably includes a first and second opposing broad face, but can alternatively have any other suitable configuration. The light emitting elements 540 are preferably all mounted along a single broad face, such that the subsequently emitted light emanates from a first substrate 520 broad face (e.g., as shown in FIG. 20), but can alternatively be mounted along the first and second substrate broad faces (e.g., as shown in FIG. 19), or mounted in any other suitable configuration. The light emitting elements 540 can be mounted on the broad face tracing the perimeter of the substrate 520, in lines radiating from the substrate 520 central axis, in concentric circles, or in any other suitable pattern or arrangement. The light emitting elements 540 can be mounted to the substrate 520 with the normal vector of the light emitting element active surface parallel to the substrate normal vector, can be mounted with the normal vector of the light emitting element active surface perpendicular to the substrate normal vector (e.g., as shown in FIG. 22), or be mounted in any other suitable configuration.

Figure 21:
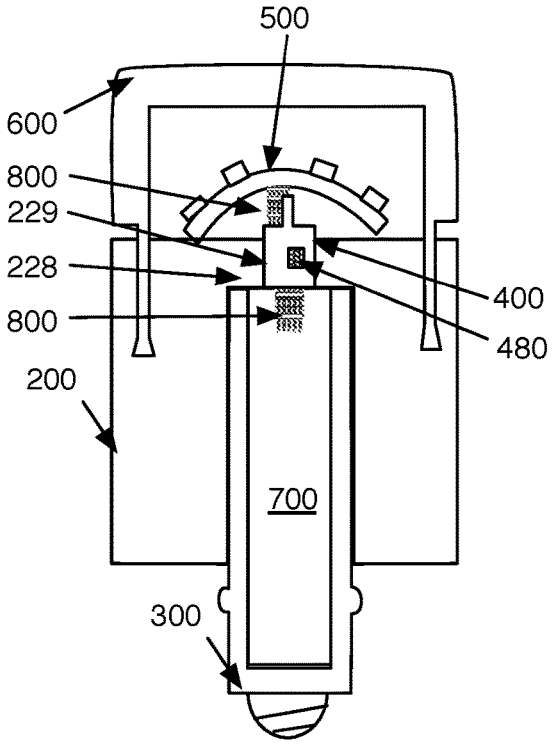

The substrate 520 functions to physically retain the light emitting elements 540, and can additionally electrically connect the light emitting elements 540 to a power source (e.g., the power storage unit 700, primary power supply, etc.) and/or the circuit board 400. The substrate 520 preferably includes a set of patterned electrical traces, but can alternatively include any other suitable electrical connection. The substrate 520 can be planar, curved (e.g., as shown in FIG. 21), or have any other suitable shape. The substrate profile can substantially mirror the outer wall cross section, mirror the inner wall cross section, be circular, ovular, triangular, rectangular, or have any other suitable profile. One or more of the substrate dimension can be substantially equal to, slightly smaller than, or slightly larger than the outer wall cross section, inner wall cross section, recess defined by the fins 260, or any other suitable component. In one example, the substrate diameter can be slightly smaller than the outer wall diameter. In a second example, the substrate diameter can be substantially equal to the inner wall diameter. Alternatively the substrate 520 can have any other suitable set of dimensions.

The substrate 520 can include a secondary antenna aperture that functions to permit antenna 430 extension therethrough, as shown in FIG. 20. The secondary antenna aperture preferably aligns with the first antenna aperture 229 of the end plate when the lighting assembly 100 is assembled, but can alternatively be misaligned or otherwise arranged. The secondary antenna aperture can be substantially the same size as the first antenna aperture 229 (e.g., have substantially the same dimensions), larger than the first antenna aperture 229, smaller than the first antenna aperture 229, or have any other suitable set of dimensions.

The substrate 520 can additionally include a set of sensors 480, such as ambient light sensors, sound sensors, accelerometers, or any suitable sensor. The sensors 480 are preferably arranged on the same substrate face as the light emitting elements 540 (e.g., as shown in FIG. 20), but can alternatively be arranged on an opposing face, adjacent face, or any other suitable substrate face. Alternatively, the sensors 480 can be mounted on the circuit board 400, shell 200, insert, diffuser 600, lighting module 500, or any other suitable component.

The light emitting elements 540 of the lighting module 500 function to emit light. Alternatively, the lighting module 500 can include electromagnetic signal emitting elements in lieu of the light emitting elements 540. The light emitting elements 540 are preferably solid-state lighting elements, but can alternatively be incandescent bulbs, fluorescent tubes, or any other suitable lighting element. The solid-state light emitting elements can be semiconductor light-emitting diodes (LEDs), organic light-emitting diodes (OLED), or polymer light-emitting diodes (PLED) or any other suitable light emitting element. The light emitting elements 540 can be individually controllable (e.g., independently indexed), controlled as a set, controlled as a set of subsets, or controlled in any suitable manner. The light emitting elements 540 can be connected in parallel, connected in series, connected in a combination of series and parallel, or be connected in any other suitable manner.

The lighting module 500 is preferably arranged along a first end in of the lighting assembly 100, more preferably along a first end of the shell distal the base 360, but can alternatively be arranged in any other suitable position. The lighting module 500 can be mounted to the shell 200, to the insert, to the diffuser 600, and/or any other suitable lighting component. In a first variation, the lighting module 500 is mounted to the inner wall 220 and retained by the end cap broad face or the first end of the inner wall 220. In a second variation, the lighting module 500 sits in a recess, defined between the inner and outer walls by profiled fin ends, and is mounted to one or more fin ends or fin broad faces. In a third variation, the lighting module 500 is mounted to the diffuser 600. However, the lighting module 500 can be mounted to any other suitable component. The lighting module 500 can be mounted to the mounting point by a mounting mechanism 900. Examples of mounting mechanisms include screws, clips, adhesive, hooks, or any other suitable mounting mechanism. The lighting module 500 is preferably arranged with a broad face perpendicular a lighting assembly longitudinal axis 113 (e.g. the shell or insert longitudinal axis), but can alternatively be arranged parallel the housing assembly longitudinal axis or be arranged in any other suitable configuration. The lighting module 500 can be arranged such that the light emitting elements 540 are directed along a vector parallel to the housing assembly longitudinal axis, can be arranged such that the light emitting elements 540 are directed along a vector radially outward of or perpendicular to the longitudinal axis, or arranged in any other suitable orientation.

In a first variation, the lighting module 500 can be arranged with the active surfaces of the light emitting elements 540 directed toward the base 360 or the shell 200. In one example, the light emitting elements 540 can be arranged on the substrate broad face proximal the fins 260, wherein the fins 260 can function as reflectors or diffusers for the emitted light. In this example, the fins 260 are preferably profiled with the lower or shorter fin portion arranged radially outward of the inner wall 220, and the outer wall 240 is preferably substantially the same length as the lower or shorter fin portion. The transition between the elevated and lowered fin portions can additionally exhibit an obtuse angle, but can alternatively exhibit a rounded profile, a right angle, or have any other suitable transition. In another example, the light emitting elements 540 can be arranged such that the emitted light shines through the cooling channels 280, such that the fins 260 function as dividers to shape the light.

In a second variation, the lighting module 500 can be arranged with the normal vectors of the light emitting element active surfaces or the subsequently emitted light directed away from the base 360, away from the shell 200, or directed in any other suitable direction. In one example, the light emitting elements 540 can be arranged on the broad face of the substrate 520 distal the shell 200. In a third variation, the lighting module 500 can be arranged with the light directed radially inward. In a fourth variation, the lighting module 500 can be arranged with the light directed radially outward. However, the lighting module 500 can be arranged in any other suitable orientation relative to the shell 200.

The lighting assembly 100 is preferably thermally connected to a thermally conductive portion of the housing, but can alternatively be thermally insulated from the thermally conductive portions of the housing. In one variation, the lighting module 500 is thermally connected to the shell 200, wherein the shell 200 functions as a heatsink for the lighting module 500. The lighting module 500 can be thermally connected to the end cap 228, the inner wall 220, the outer wall 240, the fins 260, or any other suitable portion of the shell 200. In this variation, the lighting module 500 can include a heatsink 570 or other thermal path thermally connecting the module and the shell 200, as shown in FIG. 19. In this variation, the lighting module 500 can additionally include electrical insulation to prevent trace shorting between the substrate 520 and the thermally conductive component. In a specific example, the mounting components mounting the lighting module 500 to the shell 200 can function as heat transfer paths between the lighting module 500 and the shell 200. In a second example, the lighting module 500 includes a heatsink arranged along a broad face of the substrate 520 proximal the shell 200 (e.g., end cap 228). However, the lighting module 500 can be thermally connected to any other suitable thermally conductive component. In a second variation, the lighting module 500 is thermally insulated from the thermally conductive portions of the housing, such as the shell 200, wherein the lighting module 500 can generate less heat than other heat-generating components, such as the chip. In this variation, the lighting module 500 can be mounted to the thermally conductive component, but include thermal insulation 560 (e.g., standoffs or other thermal insulation) between the lighting module 500 and the component, as shown in FIG. 20. Alternatively, the lighting module 500 can be mounted to a thermally insulated component, such as the diffuser 600.

The diffuser 600 of the housing assembly no of the lighting assembly 100 functions to physically protect and/or conceal the lighting module 500, circuit board 400, and/or power storage unit 700. The diffuser 600 can additionally function to adjust the properties of the light emitted by the lighting module 500. More preferably, the diffuser 600 functions to diffuse and blend the light emitted by the individual light emitting elements 540 or different EM signal emitting element sets. The diffuser 600 can be translucent and diffuses light, but can alternatively be a color filter or include any other suitable component that adjusts any other suitable optical property. The diffuser 600 can be transparent, opaque, selectively transparent to a predetermined set of wavelengths, react to a given wavelength (e.g., fluoresce), or have any other suitable optical property. The diffuser 600 can have the same optical property over the entirety of an active surface, varying optical properties over the active surface, or any other suitable optical property distribution. In a specific example, the diffuser 600 can have a clear area through which a light sensor 480 can measure ambient light. The diffuser 600 can be arranged distal the shell 200 across the lighting module 500, such that the lighting module 500 is arranged between the diffuser 600 and shell 200. Alternatively, the diffuser 600 can be arranged distal the base 360 with the lighting module 500, power supply unit, and/or circuit board 400 arranged between the diffuser 600 and base 360. Alternatively, the diffuser 600 can be arranged in any other suitable position.

Figure 25:
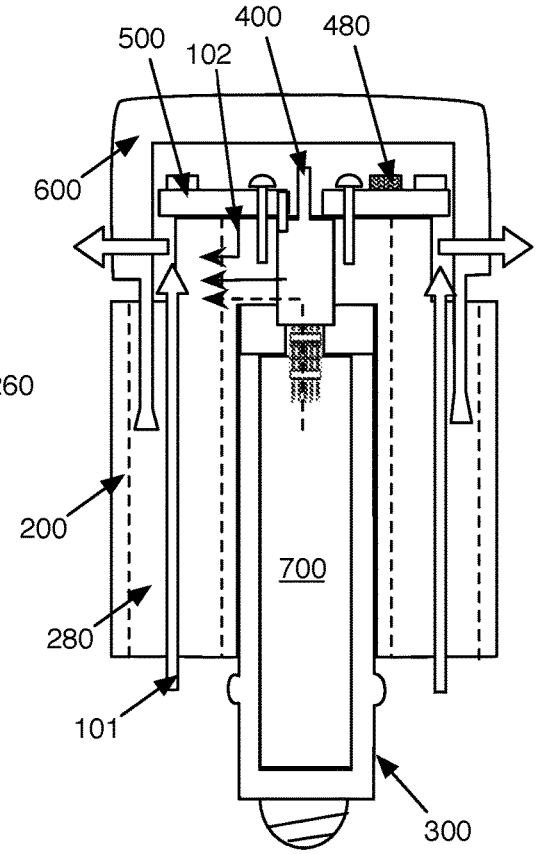
FIG. 25 is a schematic representation of a variant of the lighting assembly including heat transfer paths and air flow paths.

The diffuser cross sectional dimensions preferably substantially mimic that of the outer wall 240, but can alternatively have any other suitable set of dimensions. In one variation, the diffuser 600 is a cap including a broad face and walls extending at a non-zero angle from the broad face (e.g., extending along a normal vector to the broad face). However, the diffuser 600 can be a substantially planar piece or have any other suitable form factor. In the shell variation in which the inner wall 220 is longer than the outer wall 240, the diffuser wall can extend beyond the inner wall end plane approximately the difference between the inner wall 220 and the outer wall lengths. However, the walls can have any other suitable configuration. The diffuser 600 can have apertures through the wall thickness and/or broad face to facilitate thermal transfer to a cooling medium (e.g., ambient air), as shown in FIG. 25.

The diffuser 600 preferably mounts to the shell 200, but can alternatively mount to the insert 300 (e.g., through the first and second antenna apertures) or to any other suitable housing component. The diffuser 600 preferably mounts to the first end of the shell 200, but can alternatively mount to the side of the shell 200, the second end of the shell 200, or to any other suitable housing component. The diffuser 600 can mount to the interior wall of the outer wall 240, the exterior wall of the inner wall 220, the ends of the fins 260, the broad faces of the fins 260, or to any other suitable portion of the shell 200. In one variation, the diffuser walls 620 include coupling mechanisms (e.g., clips, barbs, hooks, threading, etc.) that couple to complimentary features on the mounting component. In another variation, the diffuser broad face 610 can include mounting features extending from the broad face side proximal the mounting component, which couple to complimentary features on the mounting component. These mounting features can additionally extend through and retain the lighting module 500 position relative to the shell 200. In another variation, the diffuser 600 can be mounted to the mounting component with a separate mounting component, such as a set of screws. In a specific example, the diffuser walls 620 can extend into the cooling channels 280 and a set of screws extending radially inward toward can mechanically retain the diffuser position relative to the shell 200. However, the diffuser 600 can mount to the housing assembly no in any other suitable manner.

The power storage unit 700 (power supply unit, power source unit) of the lighting assembly 100 functions to provide backup power 40 to the lighting assembly components when primary power source power provision has ceased. The power storage unit 700 can selectively power the memory, the communication module 420, the lighting module 500, or any other suitable lighting assembly component when primary power is unavailable. The power supply unit can alternatively or additionally function to condition primary power for the lighting assembly powered components, wherein the power supply unit accepts primary power and outputs lighting assembly component power having a voltage and/or current acceptable to the lighting assembly component. The power supply unit preferably stores, receives, and supplies electric power, but can alternatively harvest energy and convert the harvested energy to electric power, generate electric power, or otherwise supply electric power. The power supply unit is preferably a set of secondary batteries (rechargeable batteries), and can have lithium chemistry (e.g., lithium polymer, lithium ion, etc.), nickel cadmium chemistry, platinum chemistry, magnesium chemistry, or any other suitable chemistry. The set of secondary batteries are preferably electrically connected in parallel, but can alternatively be connected in series or a combination thereof. In one variation, the secondary batteries can include a set of battery units connected in parallel, wherein each battery unit is formed from a set of battery cells connected in series. Each battery unit can have a voltage suitable for the lighting module 500, circuit board 400, and/or other lighting assembly component. In a second variation, the secondary batteries can include a set of battery units connected in series, wherein each battery unit is formed from a set of battery cells connected in parallel. The set of battery units preferably cooperatively form the voltage suitable for the lighting module 500, circuit board 400, and/or other lighting assembly component. However, the set of secondary batteries can be otherwise configured. Alternatively, the power supply can be a set of primary batteries, a fuel cell with a fuel source (e.g., hydrogen gas source, such as a metal hydride or other gas storage, methane source, etc.), a set of chemical reagents, an energy harvesting mechanism (e.g., a piezoelectric), or any other suitable power supply unit or combination thereof.

The power supply unit is preferably arranged within the power supply lumen of the insert, but can alternatively be arranged between the inner and outer walls, within the inner lumen 222 of the inner wall 220, or arranged in any other suitable position. The power supply unit is preferably retained within the power supply lumen between the base 360 and a retention mechanism, but can alternatively be clipped, adhered (e.g., potted, epoxied, etc.), screwed in, or otherwise retained within the power supply lumen. The retention mechanism is preferably the circuit plate 340, but can alternatively be a separate piece. In one variation, the retention mechanism includes a cap that snaps into a set of grooves extending about an arcuate surface of the power supply lumen interior. However, the power supply unit can be otherwise retained within the lighting assembly 100.

The power supply unit can additionally include a battery management circuit 460 that functions to manage battery charging and discharging (e.g., battery cell or string balancing). The battery management circuit 460 is preferably part of the circuit board 400, and can be the processor 410 or a secondary circuit. Alternatively, the battery management circuit 460 can be arranged on a secondary circuit board 400.

In a first specific example, the lighting assembly 100 includes a shell 200, insert, power storage unit 700, circuit board 400, and lighting module 500. The shell 200 includes a first end and a second end. The shell 200 includes an inner wall 220 defining an inner lumen 222 with an end cap substantially sealing the inner lumen end proximal the first shell end, an outer wall 240 concentrically arranged about the inner wall 220, and a set of fins 260 extending radially between and thermally connecting the inner wall 220 and outer wall 240. The inner wall 220, outer wall 240, and adjacent fins 260 cooperatively define a set of cooling channels 280 extending along the longitudinal axis of the shell 200, wherein the cooling channels 280 have a first and second open end arranged along the first and second end of the shell 200, respectively. The end cap 228 can include a first antenna aperture 229. The inner and outer walls are preferably cylindrical, but can be tapered or have any other suitable configuration. The shell 200, including the shell components, is thermally conductive, and preferably made of metal. The insert 300 is mounted within the inner lumen 222, and can be coaxially arranged with the inner lumen 222. The insert 300 is thermally insulative. The insert 300 defines a power storage lumen 320 and includes a base 360 at a second insert end. The first insert end opposing the base 360 is preferably open, and configured to receive the power storage unit 700. The insert 300 can additionally include a circuit plate 340 extending along a chord of the power storage lumen 320, wherein the circuit plate 340 can be inserted after power storage unit 700 insertion into the power storage lumen 320. The circuit plate 340 can define a receptacle for the circuit board 400. The circuit plate 340 is arranged proximal the first end of the insert, or the insert end configured to be proximal the end cap. The power storage unit 700 includes a set of secondary batteries, and is arranged within the power storage lumen 320 proximal the base 360 or second end. The circuit board 400 includes a processor 410, and a communication module 420 with an antenna 430, and can additionally include a power management circuit, power conditioning circuit, and memory. The antenna 430 preferably extends beyond the circuit board body. The circuit board 400 is retained by the circuit plate 340 in the insert 300. All or most of the circuit board 400 preferably extends beyond the insert boundaries, but most of the circuit board 400 can be encompassed by the insert 300. The antenna 430 preferably extends beyond the insert boundary. The lighting module 500 includes a substrate 520 with a plurality of light emitting elements 540 mounted to a first broad face of the substrate. The substrate 520 is planar, and is mounted to the end cap with the first broad face distal the end cap. The substrate 520 can include a second antenna aperture 522, as shown in FIG. 7. When assembled, the antenna 430 extends through the first and second antenna apertures, such that the antenna 430 terminates at a point beyond the lighting module 500, opposing the shell 200. The lighting module 500 includes a set of light emitting elements mounted to a single broad face of the substrate. The diffuser 600 is preferably a cap with walls, and fits over the lighting module 500. The diffuser 600 can additionally fit over and extend along a portion of the inner wall 220 and/or fins 260, if the inner wall 220 extends beyond the outer wall 240. The diffuser 600 clips to the shell 200, more preferably the outer wall 240, but can alternatively mount to any other suitable shell component.

In one variation, the lighting assembly 100 can be assembled using a top-down approach. Lighting system assembly can include orienting the insert with the base 360 aligned below the open end along a gravity vector, inserting the power supply unit into the power supply lumen, inserting the circuit plate 340 into the power supply lumen to retain the power supply unit, inserting the circuit board 400 into the circuit plate 340, wherein circuit board 400 insertion also connects the circuit board 400 to the power supply unit and/or electrical connections of the insert 300, aligning the shell inner lumen 222 with the insert, coupling the shell 200 over the insert 300, such that the circuit board antenna 430 extends thorough the antenna aperture, aligning the lighting module 500 antenna aperture with the antenna 430 such that the antenna 430 extends through the lighting module 500 antenna aperture, coupling the lighting module 500 over the shell 200, wherein lighting module coupling can additionally electrically connect the lighting module 500 to the circuit board 400, mounting the lighting module 500 to the end cap with a set of mounting mechanisms (e.g., screws), and clipping the diffuser 600 over the lighting module 500 to the shell 200. However, the lighting assembly 100 can be otherwise assembled.

In a second specific example, the lighting assembly 100 includes a shell 200, insert, power storage unit 700, circuit board 400, and lighting module 500. The shell 200 includes a first end and a second end. The shell 200 includes an inner wall 220 defining an inner lumen 222 with an end cap substantially sealing the inner lumen end proximal the first shell end, an outer wall 240 concentrically arranged about the inner wall 220, and a set of fins 260 extending radially between and thermally connecting the inner wall 220 and outer wall 240. The inner wall 220, outer wall 240, and adjacent fins 260 cooperatively define a set of cooling channels 280 extending along the longitudinal axis of the shell 200, wherein the cooling channels 280 have a first and second open end arranged along the first and second end of the shell 200, respectively. The end cap 228 includes a first antenna aperture 229. The inner and outer walls are preferably cylindrical, but can be tapered or have any other suitable configuration. The shell 200, including the shell components, is thermally conductive, and preferably made of metal. The insert 300 is mounted within the inner lumen 222, and can be coaxially arranged with the inner lumen 222. The insert 300 is thermally insulative. The insert 300 defines a power storage lumen 320 and includes a base 360 at a second insert end. The first insert end opposing the base 360 is preferably open, and configured to receive the power storage unit 700. The power storage unit 700 includes a set of secondary batteries, and is arranged within the power storage lumen 320 proximal the base 360 or second end. The circuit board 400 includes a processor 410, and a communication module 420 with an antenna, and can additionally include a power management circuit, power conditioning circuit, and memory. The antenna 430 can remain within the boundaries of the circuit board body, or extend beyond the circuit board body. The circuit board 400 is mounted to the shell 200 with a broad circuit board face parallel a longitudinal shell axis. The circuit board 400 is preferably mounted to the inner wall exterior surface, but can alternatively be mounted to the outer wall interior surface. The shell 200 includes a cutout with a door through which the circuit board 400 can be accessed, wherein the circuit board 400 is mounted radially inward of the door when mounted to the inner wall 220, or mounted to the door when mounted to the outer wall 240. The lighting module 500 includes a substrate 520 with a plurality of light emitting elements 540 mounted to a first broad face of the substrate 520. The substrate 520 is planar, and is mounted to the fin ends and/or inner wall end with the first broad face distal the shell 200. The diffuser 600 is preferably a cap with walls, and fits over the lighting module 500 such that the walls couple to the shell 200.

Although omitted for conciseness, the preferred embodiments include every combination and permutation of the various system components and the various method processes.

As a person skilled in the art will recognize from the previous detailed description and from the figures and claims, modifications and changes can be made to the preferred embodiments of the invention without departing from the scope of this invention defined in the following claims.

We claim:

1. A lighting assembly, comprising:

a processing system;

a wireless communication module electrically connected to the processing system;

a radio-frequency (RF) component electrically coupled to the wireless communication module at a first end of the RF component, wherein the RF component is structurally supported at the first end;

a metal housing encircling the wireless communication module and the first end of the RF component; and a lighting module mounted to the metal housing and electrically connected to the processing system, the lighting module comprising a substrate and a set of light emitting elements mounted to the substrate, wherein the RF component extends through a substrate thickness, wherein the RF component is arranged between a first and second light emitting element of the set of lighting elements.

2. The lighting assembly of claim 1, wherein the metal housing comprises a metal shell encircling the wireless communication module, wherein the RF component extends beyond an end of the metal shell.

3. The lighting assembly of claim 2, wherein the lighting module is mounted to and thermally connected to the end of the metal shell.

4. The lighting assembly of claim 1, wherein the metal housing comprises a base and an end cap opposing the base, wherein the base and end cap cooperatively enclose the processing system, wherein the RF component extends through the end cap.

5. The lighting assembly of claim 4, wherein the end cap is thermally conductive and the lighting module is thermally connected to the end cap.

6. The lighting assembly of claim 1, further comprising a battery, comprising lithium ion chemistry, that is enclosed within the metal housing.

7. The lighting assembly of claim 1, further comprising memory configured to store wireless connection credentials for the wireless communication module.

8. The lighting assembly of claim 7, wherein the wireless communication module comprises a WiFi communication module.

9. The lighting assembly of claim 7, wherein the wireless communication module comprises a Zigbee module.

10. The lighting assembly of claim 1, wherein the wireless communication module comprises a wireless repeater.

11. The lighting assembly of claim 1, wherein the RF component extends through the substrate thickness via an aperture defined through the substrate thickness.

12. The lighting assembly of claim 1, wherein the metal housing comprises an outer wall which defines a central axis and a set of cooling channels, the set of cooling channels extending axially along a length of the central axis and arranged radially inward of the outer wall relative to the central axis.

13. The lighting assembly of claim 1, wherein the RF component is a radio-frequency antenna.

14. The lighting assembly of claim 13, wherein the RF component is a unitary body.

15. The lighting assembly of claim 1, wherein the substrate comprises a broad face, wherein each of the set of light emitting elements is mounted to the broad face.

16. The lighting assembly of claim 1, wherein the first end of the RF component is mechanically decoupled from the substrate.

17. A lighting assembly, comprising:

a processing system;

a wireless communication module electrically connected to the processing system, the wireless communication module comprising a wireless repeater;

a radio-frequency (RF) component electrically coupled to the wireless communication module at a first end of the RF component, wherein the RF component is structurally supported at the first end;

a metal housing encircling the wireless communication module and the first end of the RF component; and a lighting module mounted to the metal housing and electrically connected to the processing system, the lighting module comprising a substrate and a set of light emitting elements mounted to the substrate, wherein the RF component extends through a substrate thickness.

18. The lighting assembly of claim 17, wherein the RF component is arranged between a first and second light emitting element of the set of lighting elements.

* * * * *